US008038284B2

(12) United States Patent
Hori et al.

(10) Patent No.: US 8,038,284 B2
(45) Date of Patent: Oct. 18, 2011

(54) LIQUID APPLICATION APPARATUS AND METHOD, AND IMAGE FORMING APPARATUS

(75) Inventors: Hisamitsu Hori, Kanagawa-ken (JP); Hiroshi Uemura, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 535 days.

(21) Appl. No.: 12/204,599

(22) Filed: Sep. 4, 2008

(65) Prior Publication Data

US 2009/0056749 A1 Mar. 5, 2009

(30) Foreign Application Priority Data

Sep. 5, 2007 (JP) ..... 2007-230607

(51) Int. Cl.
*B41J 2/01* (2006.01)

(52) U.S. Cl. ..... 347/103; 347/101

(58) Field of Classification Search ..... 347/103, 347/88, 99, 101; 136/4
See application file for complete search history.

(56) References Cited

U.S. PATENT DOCUMENTS

| | | | | |
|---|---|---|---|---|
| 6,109,746 | A * | 8/2000 | Jeanmaire et al. | 347/103 |
| 7,281,790 | B2 * | 10/2007 | Mouri et al. | 347/103 |
| 7,887,177 | B2 * | 2/2011 | Doi et al. | 347/103 |

FOREIGN PATENT DOCUMENTS

| | | | |
|---|---|---|---|
| JP | 4-64488 A | | 2/1992 |
| JP | 10-230201 A | | 9/1998 |
| JP | 2001-166448 A | | 6/2001 |
| JP | 2001166448 A | * | 6/2001 |
| JP | 2006-95489 A | | 4/2006 |

* cited by examiner

*Primary Examiner* — Manish S Shah
(74) *Attorney, Agent, or Firm* — Birch, Stewart, Kolasch & Birch, LLP.

(57) ABSTRACT

A liquid application apparatus includes: a roller member which is driven so as to rotate in a rotational direction; an application liquid supply device which supplies an application liquid onto a portion of the roller member while the roller member is rotating; a blade member which is arranged so as to abut against a circumferential surface of the roller member at an abutment position that is on a downstream side of the application liquid supply device in terms of the rotational direction of the roller member, the blade member wiping away an excess of the supplied application liquid on the roller member; a substitute fluid spray device which is arranged on a downstream side of the abutment position of the blade member in terms of the rotational direction of the roller member, the substitute fluid spray device spraying a substitute fluid onto a region of the circumferential surface of the roller member so as to remove the application liquid on the region of the circumferential surface of the roller member after the roller member passing the abutment position of the blade member, the substitute fluid including one of gas and liquid that is different from the application liquid; and a substitute fluid spray control device which controls the substitute fluid spray device to spray the substitute fluid.

18 Claims, 20 Drawing Sheets

LIQUID APPLICATION APPARATUS AND METHOD, AND IMAGE FORMING APPARATUS

BACKGROUND OF THE INVENTION

1. Field of the Invention

The present invention relates to a liquid application apparatus and method, and to an image forming apparatus, and more particularly to a liquid application apparatus and method having a composition in which liquid is supplied onto the surface of a round cylindrical member, such as a gravure roller, and to an image forming apparatus having a composition in which treatment liquid (undercoating liquid) is applied using this liquid application apparatus and method.

2. Description of the Related Art

Japanese Patent Application Publication No. 4-64488 discloses technology for stabilizing an application process by separating a doctor blade from a gravure roller (also referred to as a "gravure cylinder") to remove the remaining application liquid left between the doctor blade and the gravure roller by means of a fluid, each time application is performed on a substrate.

Japanese Patent Application Publication No. 10-230201 discloses technology for preventing an application liquid from drying out and becoming affixed to the surface of an application roller, by separating a pressing roller (also referred to as an "impression roller") and application liquid tank, when application liquid is not being applied onto a receiving body.

Japanese Patent Application Publication No. 2001-166448 discloses technology for reducing image application non-uniformities by leveling a sprayed treatment liquid by means of a roller, a blade, or an air flow.

Japanese Patent Application Publication No. 2006-95489 discloses technology for achieving application of an ultra-thin layer having a film thickness of not greater than 10 μm, by reverse rotation application using a gravure roller, and it also discloses technology for curing an applied film by irradiating ultraviolet light while supplying an inert gas.

In the invention described in Japanese Patent Application Publication No. 4-64488, although it is possible to stabilize application by removing remaining liquid by means of air or liquid, it is not suitable for high-speed processing since the doctor blade needs to be separated from the gravure roller frequently. Furthermore, it is also difficult to control application in the conveyance direction and the breadthways direction.

In the invention disclosed in Japanese Patent Application Publication No. 10-230201, although it is possible to reduce affixation onto the roller surface, there is a problem in that application non-uniformities are liable to occur due to the effects of residual fixed material. Furthermore, when the application liquid in the application liquid tank is separated, then it is possible to control application in the conveyance direction, but liquid trails are liable to occur and the response is not satisfactory.

In the invention disclosed in Japanese Patent Application Publication No. 2001-166448, although it is possible to simplify the application of the liquid by means of the spraying of treatment liquid from nozzles, during rotation of the roller in the forward direction, or pressing of the blade, non-uniformities such as stripe-shaped non-uniformities are liable to occur, and the treatment liquid that has dried and solidified is liable to become attached to the roller or blade. Moreover, non-uniformities are liable to occur in the breadthways direction due to air blowing, and it is difficult to control the application thickness by means of air blowing.

In the invention disclosed in Japanese Patent Application Publication No. 2006-95489, the treatment liquid which has dried and solidified is liable to become attached to the roller, and even when application has been halted, liquid trails are liable to occur and therefore the control characteristics cannot be regarded as satisfactory.

Moreover, in the field of inkjet recording, intermediate transfer methods have been investigated in the related art, with the object of achieving good image formation onto media of various types, and it has been found that, in particular, a method which applies an undercoating liquid (treatment liquid) such as an ink aggregation agent, to an intermediate transfer body is suitable for forming images. When an image is formed on a cut paper by means of this method, then although good reverse rotation application is achieved on the gravure roller, which enables good film thickness uniformity when applying the undercoating liquid (see Japanese Patent Application Publication No. 2006-95489), it is difficult to control the application range and there are cases where the undercoating liquid adhering to portions outside the paper becomes attached to the transfer roller, and the intermediate transfer body becomes soiled by retransfer of this liquid. Furthermore, in cases where the undercoating liquid is acidic, then corrosion of the structural members, such as the transfer roller, may be caused by the liquid. Moreover, in cases where liquid has been attached to the gravure roller for a long period of time also, there is a possibility of drying solidification or damage resulting from corrosion.

SUMMARY OF THE INVENTION

The present invention has been contrived in view of these circumstances, an object thereof being to provide a liquid application apparatus and an image forming apparatus using same, whereby the control of the application range can be improved in an application method using a roller member, while also minimizing damage caused to the members by components in the application liquid, in addition to drying and solidification of the liquid.

In order to attain the aforementioned object, the present invention is directed to a liquid application apparatus, comprising: a roller member which is driven so as to rotate in a rotational direction; an application liquid supply device which supplies an application liquid onto a portion of the roller member while the roller member is rotating; a blade member which is arranged so as to abut against a circumferential surface of the roller member at an abutment position that is on a downstream side of the application liquid supply device in terms of the rotational direction of the roller member, the blade member wiping away an excess of the supplied application liquid on the roller member; a substitute fluid spray device which is arranged on a downstream side of the abutment position of the blade member in terms of the rotational direction of the roller member, the substitute fluid spray device spraying a substitute fluid onto a region of the circumferential surface of the roller member so as to remove the application liquid on the region of the circumferential surface of the roller member after the roller member passing the abutment position of the blade member, the substitute fluid including one of gas and liquid that is different from the application liquid; and a substitute fluid spray control device which controls the substitute fluid spray device to spray the substitute fluid.

In this aspect of the present invention, it is possible to stabilize the amount of liquid supplied onto the roller member by means of the blade member, and furthermore, since the supplied liquid can be removed selectively in regions where the substitute fluid (gas or a liquid that is different from the application liquid) is sprayed, then it is possible to form selectively, on the circumferential surface of the roller, an application region where the application liquid is present, and a non-application region where the application liquid is not present. Furthermore, by controlling the spraying of the substitute fluid, it is possible to control the application region (the application surface area), and therefore excellent control response can be achieved.

The "liquid that is different from the application liquid" (i.e., liquid having a composition different from the application liquid) used as the substitute fluid is desirably a liquid having a high surface tension (making it less liable to adhere), neutral properties (to prevent corrosion of the members), and a low boiling point (making it liable to evaporate), and furthermore, desirably, it is distilled water or purified water, or one of these liquids containing, additionally, a preservative agent and an anti-corrosion agent, or the like.

Preferably, the circumferential surface of the roller member has recess sections to retain the application liquid.

For example, for the roller member it is suitable to use a gravure roller in which a plurality of precise cells having a prescribed recess shape are formed at a prescribed density on the surface of the roller.

By using this roller, the uniformity of application is ensured, the thickness of the applied layer can be changed by adjusting the shape of the indentations, and application of particles having a larger particle size than the application thickness, such as polymer resin, can be achieved. Alternatively, it is also possible to use a spiral roller which has spiral-shaped grooves formed in the surface of the roller. In this case, cost savings can be made in comparison with a gravure roller, and improved control in the conveyance direction and the breadthways direction can also be achieved. With regard to the direction of conveyance, substitution by means of the substitute fluid can be performed effectively since the roller grooves are formed so as to be parallel with the circumferential direction. As regards the breadthways direction, spreading of the liquid in the breadthways direction can be restricted by the grooves.

Preferably, the substitute fluid spray device sprays the substitute fluid onto the circumferential surface of the roller member within a sprayable range that is wider in a width direction of the roller member than a range on which the application liquid is supplied; and the substitute fluid spray control device controls the substitute fluid spray device to spray and not to spray the substitute fluid.

In this aspect of the present invention, it is possible reliably to remove the application liquid on the roller member, by spraying the substitute fluid onto the regions of the outer circumferential surface of the roller member where the application liquid is not required, in respect of the direction of rotation. On the other hand, by controlling and switching off the spraying of the substitute fluid in the region where the application liquid is required, then an application liquid film of uniform thickness created by the blade member is left in this region. It is possible to arrange a plurality of independently-controllable substitute fluid spray devices in the breadthways direction, and to spray the substitute fluid onto the region where the application liquid is not required, in respect of the breadthways direction.

Preferably, the above-described liquid application apparatus further includes a shielding member which is arranged on a downstream side of the substitute fluid spray device in terms of the rotational direction of the roller member, the shielding member preventing the application liquid from scattering when the substitute fluid spray device removes the application liquid, wherein the substitute fluid spray device sprays the substitute fluid onto the region of the circumferential surface of the roller member that is exposed between the blade member and the shielding member.

In this aspect of the present invention, the spraying range of the substitute fluid is limited in the direction of rotation by means of the shielding member and the blade member, the substitute fluid is sprayed in the range of the opening slit (i.e., the spraying range; a region between the shielding member and the blade member), and the control of the substitute fluid in the direction of rotation is also improved. In other words, a sharp distinction can be achieved between the region where the substitute fluid is sprayed ("ON" state of the substitute fluid) and the region where the substitute fluid is not sprayed ("OFF" state of the substitute fluid).

Preferably, wherein the blade member has an inclined surface along which the removed application liquid flows down from the circumferential surface of the roller member, substantially in a direction of gravity.

In this aspect of the present invention, the liquid removed by spraying the substitute fluid flows down along the blade member, and it is possible to prevent stagnation of the liquid at the front end portion of the blade member. It is therefore possible to achieve good control of liquid removal in the direction of rotation.

Preferably, the above-described liquid application apparatus further includes a container which accommodates the roller member and the blade member, wherein the blade member also serves as a partition which divides an interior of the container, and separates the excess of the application liquid wiped away by the blade member and the application liquid removed by the substitute fluid spray device.

In this aspect of the present invention, the space inside the container is demarcated by using the blade member itself as a partition, and it is possible to recover the excess liquid which has been wiped away by the blade member, and the liquid removed by the substitute fluid, respectively and independently.

It is possible to adopt a composition in which a portion of the roller member is immersed in the application liquid which is stored in a container, as the application liquid supply device. Furthermore, as a further mode of the application liquid supply device, it is also possible to use an application liquid spray device which sprays the application liquid onto a portion of the roller member.

In this case, moreover, a desirable mode is one which comprises a spray width control device which variably controls the spray width of the application liquid which is sprayed by the application liquid spray device. By means of this mode, it is possible to control the application width of the application in the breadthways direction of the roller member, without having to provide a plurality of substitute fluid spray devices. Furthermore, it is also possible to prevent variation in the application thickness due to application liquid rising up at the end portions of the roller member, a phenomenon which is liable to occur in a composition in which the roller member is partially immersed. As a device for altering the spraying width, it is possible to adopt, for example, a mode based on controlling the spraying pressure from a flat spray nozzle. Alternatively, either instead of or in conjunction with this composition, it is also possible to employ a mechanism which alters the width of the opening slit which governs the spraying range.

Preferably, the application liquid on the roller member is applied onto an application receiving body by conveying the application receiving body in a direction opposite to the rotational direction of the roller member while the application receiving body is in contact with the roller member.

By selectively applying the application liquid onto the outer circumferential surface of the roller member, and adopting a reverse coating by means of the roller member, it is possible to apply a uniform thin film having a specified liquid thickness, selectively, onto a prescribed region of the application receiving body.

A concrete example provides a liquid application apparatus in which the application receiving body is the intermediate transfer body of an intermediate transfer type inkjet recording apparatus including a cleaning device which cleans the intermediate transfer body, and the application liquid is a treatment liquid and is applied after a step of cleaning the intermediate transfer body by means of the cleaning device and before ink droplets are deposited on the intermediate transfer body. The liquid application apparatus may also be used in an inkjet recording apparatus which ejects and deposits ink droplets onto a recording medium, as an apparatus which applies liquid on the recording medium before ink droplets are deposited on the recording medium.

In order to attain the aforementioned object, the present invention is also directed to a liquid application method comprising the steps of: supplying an application liquid onto a portion of a roller member while rotating the roller member in a rotational direction; wiping away an excess of the application liquid on the portion of the roller member by means of a blade member; spraying a substitute fluid onto a region of the circumferential surface of the roller member after the wiping step so as to remove the application liquid on the region of the circumferential surface of the roller member, the substitute fluid including one of gas and liquid that is different from the application liquid; and controlling spraying of the substitute fluid in the spraying step.

In order to attain the aforementioned object, the present invention is also directed to an image forming apparatus, comprising: a treatment liquid application device which includes the above-described liquid application apparatus to apply a treatment liquid as the application liquid on an intermediate transfer body forming an application receiving body; an ink ejection device which ejects and deposits droplets of ink in accordance with an image data onto the intermediate transfer body on which the treatment liquid has been applied by the treatment liquid application device, the deposited droplets of the ink forming an ink image on an image forming region of the intermediate transfer body; and a transfer device which transfers the ink image from the intermediate transfer body to a recording medium, wherein the substitute fluid spray control device in the treatment liquid application device controls the substitute fluid spray device to spray the substitute fluid onto the region of the roller member corresponding to a non-image forming region of the intermediate transfer body other than the image forming region in accordance with the image data.

Furthermore, if an application liquid spray device of which the spray width can be controlled is used as the application liquid supply device, then a desirable mode is one in which the image forming region is judged on the basis of the image data, information about the size of the recording medium used (width dimension), and the like, and the spraying width of the application liquid is changed and controlled accordingly.

A desirable mode of implementing the present invention provides an image forming apparatus wherein the substitute fluid is a liquid having a surface tension of 60 through 80 mN/m and the surface energy of the intermediate transfer body is 15 through 30 mN/m (=mJ/m2). According to this mode, since the surface tension of the substitute fluid is larger than the surface energy of the intermediate transfer body, then the amount of the substitute fluid applied on the intermediate transfer body can be reduced, the applied liquid component can be diluted and removed effectively, and if a liquid having a low boiling point, such as water, is used, then this liquid can be driven off by means of the heat involved in the process.

Preferably, when image formation is not performed on the recording medium, the treatment liquid is not applied on the roller member but the substitute fluid is sprayed onto the roller member.

In this aspect of the present invention, when not performing image formation, the surface of the roller member is cleaned and the solidification of the application liquid and corrosion by the components in the application liquid (for example, acid) can be reduced. Furthermore, if the substitute fluid is a liquid, such as water, then the application member and the intermediate transfer body can be washed, and even more stable operation can be achieved.

According to the present invention, it is possible to control the application range readily, as well as being able to apply a liquid film having a uniform liquid thickness in the application region.

BRIEF DESCRIPTION OF THE DRAWINGS

The nature of the present invention, as well as other objects and advantages thereof will be explained in the following with reference to the accompanying drawings, in which like reference characters designate the same or similar parts throughout the figures and wherein.

DETAILED DESCRIPTION OF THE PREFERRED EMBODIMENTS

Figure 1:
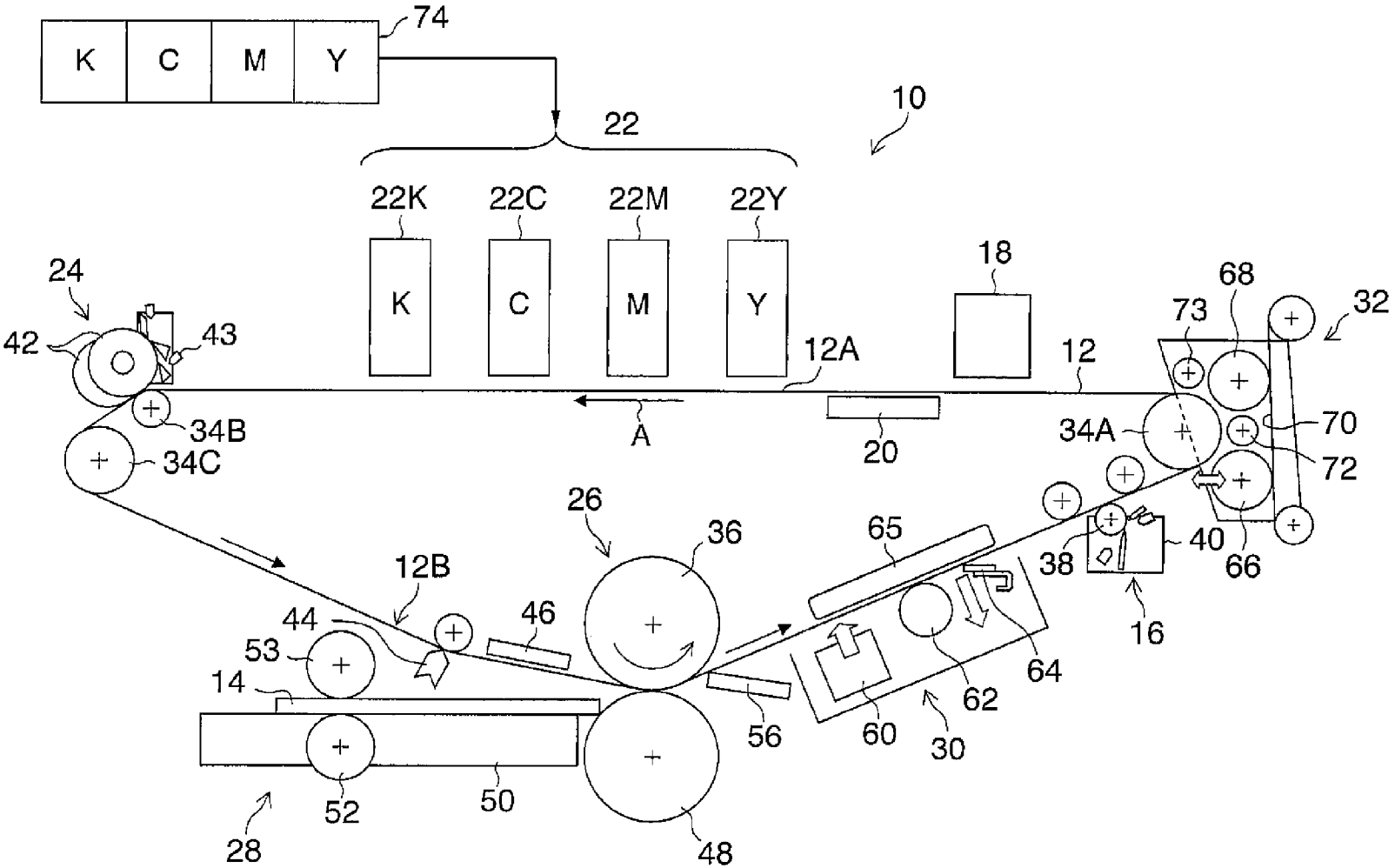
FIG. 1 is a general schematic drawing of an inkjet recording apparatus according to a first embodiment of the present invention.

General Composition of Inkjet Recording Apparatus According to First Embodiment Firstly, an inkjet recording apparatus which forms an image forming apparatus according to an embodiment of the present invention will be described. FIG. 1 is a diagram of the general composition of an inkjet recording apparatus according to a first embodiment. As shown in FIG. 1, the inkjet recording apparatus 10 according to the present embodiment is a recording apparatus using a transfer method which records an image (primary image) on an intermediate transfer body 12, which is a non-permeable body, and then forms a main image (secondary image) by transferring this image to a recording medium 14, such as a normal paper The principle compositional elements of this inkjet recording apparatus 10 are: a treatment liquid application unit 16 (corresponding to the "liquid application apparatus" according to the present invention) which applies an aggregation treatment agent (hereinafter referred to simply as "treatment liquid" in the present embodiment) onto an intermediate transfer body 12; a heating unit 18 and a cooler 20 for drying and cooling the treatment liquid which has been applied on the intermediate transfer body 12; a print unit (ink droplet ejection unit) 22 which deposits inks of a plurality of colors onto the intermediate transfer body 12; a solvent removal unit 24 which removes liquid solvent (excess solvent) on the intermediate transfer body 12 after ejection of ink droplets; a transfer unit 26 which transfers the ink image formed on the intermediate transfer body 12, onto a recording medium 14; a paper supply unit 28 which supplies a recording medium 14 to the transfer unit 26; and cleaning units (first cleaning unit 30 and second cleaning unit 32) which clean the intermediate transfer body 12 after transfer.

The treatment liquid is an acidic liquid which has the action of aggregating the coloring material which is contained in the ink, and the inks are colored inks which contain a coloring material (pigment) of the respective colors of cyan (C), magenta (M), yellow (Y) and black (K). The composition of the treatment liquid and the ink used in the present embodiment are described in detail hereinafter.

An endless belt is used for the intermediate transfer body 12. This intermediate transfer body (endless belt) 12 has a structure whereby it is wound about a plurality of rollers (three tensioning rollers 34A to 34C and a transfer roller 36 are depicted in FIG. 1, but the winding mode of the belt is not limited to this example), and the drive power of a motor (not shown in FIG. 1 and indicated by reference numeral 288 in FIG. 17) is transmitted to at least one of the tensioning rollers 34A to 34C or the transfer roller 36, thereby driving the intermediate transfer body 12 in a counter-clockwise direction in FIG. 1 (the direction indicated by the arrow A). The tensioning roller indicated by reference numeral 34C is a tensioner which serves to correct serpentine travel of the belt and to apply tension to the belt.

The intermediate transfer body 12 is formed of resin, metal, rubber, or the like, which has non-permeable properties that prevent permeation of liquid droplets of ink, in at least the image forming region (not shown) where the primary image is formed, of the surface (the image forming surface) 12A opposing the print unit 22. Furthermore, at least the image forming region of the intermediate transfer body 12 is composed so as to have a horizontal surface (flat surface) which has a prescribed flatness.

Desirable materials for use as the surface layer which includes the image forming surface 12A of the intermediate transfer body 12 are, for example, commonly known materials such as: a polyimide resin, a silicone resin, a polyurethane resin, a polyester resin, a polystyrene resin, a polyolefin resin, a polybutadiene resin, a polyamide resin, a polyvinyl chloride resin, a polyethylene resin, a fluorine resin, and the like.

The surface tension of the surface layer of the intermediate transfer body 12 is desirably set to be not less than 10 mN/m and not more than 40 mN/m. If the surface tension of the surface layer of the intermediate transfer body 12 is more than 40 mN/m, then the surface tension differential with respect to the recording medium 14 onto which the primary image is to be transferred disappears (or becomes extremely low), and the transfer properties of the ink aggregating body worsen. If, on the other hand, the surface tension of the surface layer of the intermediate transfer body 12 is less than 10 mN/m, then the design freedom (range of selection) of the intermediate transfer body 12 and the treatment liquid is restricted. This is because if the wetting properties of the treatment liquid are taken into account, it is necessary to set the surface tension of the treatment liquid to be lower than the surface tension of the surface layer on the intermediate transfer body 12, and it is difficult to make the surface tension of the treatment liquid not more than 10 mN/m, From the viewpoint of the durability and transfer characteristics onto a normal paper, the intermediate transfer body 12 according to the present embodiment is desirably a body in which an elastic material having a surface energy approximately of 15 mN/m (=mJ/$m^2$) through 30 mN/m, has been formed to a thickness of approximately 30 μm through 150 μm on the base material, such as polyimide, and it is preferable to provide a coating of silicone rubber, fluorine rubber, a fluorine elastomer, or the like as the elastic material.

The treatment liquid application unit 16 applies a treatment liquid (aggregation treatment agent) which forms an undercoating liquid, on the intermediate transfer body 12 after a cleaning step by a first cleaning unit 30, which is described below. The treatment liquid application unit 16 is disposed to the upstream side of the print unit 22, with respect to the direction of conveyance of the intermediate transfer body. Desirably, the application of the treatment liquid onto the intermediate transfer body 12 involves selective application onto the image forming section by means of reverse coating by a gravure roller 38. The detailed structure of the liquid application apparatus used in the treatment liquid application unit 16 is described later.

In other words, the treatment liquid application unit 16 is constituted of a gravure roller which forms an application roller (which corresponds to a "roller member") 38, and a treatment liquid container 40. By rotating the gravure roller 38 onto which the treatment liquid has been supplied in a direction opposite to the direction of conveyance of the intermediate transfer body 12, while the gravure roller 38 is in contact with the intermediate transfer body 12, the treatment liquid is applied onto the image forming surface 12A of the intermediate transfer body 12.

Furthermore, a desirable mode is one where the treatment liquid contains 1 wt % through 5 wt % of polymer resin (micro-particles) with the object of enhancing the transfer characteristics and the coloring material fixing properties when depositing droplets of ink.

The heating unit 18 is disposed to the downstream side of the treatment liquid application unit 16 and to the upstream side of the print unit 22. The heating unit 18 according to the present embodiment uses a heater whose temperature can be adjusted in a range of 50° C. through 100° C. The treatment liquid applied on the intermediate transfer body 12 by means of the treatment liquid application unit 16 is heated by passing through this heating unit 18 and the solvent component evaporates, thereby drying the liquid. Consequently, an aggregation treatment agent layer (namely, a thin film layer formed by drying the treatment liquid) which is in a solid state or a semi-solid state is formed on the surface of the intermediate transfer body 12.

The "aggregation treatment agent layer in a solid state or a semi-solid state" referred to here includes a layer of which the percentage of water content as defined below is 0% through 70%:

$$\text{percentage of water content} = \frac{A}{B} \times 100,$$

where A is weight of water contained in the treatment liquid after drying per unit surface area ($g/m^2$), and B is weight of the treatment liquid after drying per unit surface area ($g/m^2$).

A cooler 20 is disposed on the downstream side of the heating unit 18 in the conveyance direction of the intermediate transfer body, and to the upstream side of the print unit 22. This cooler 20 is disposed on the rear surface side of the intermediate transfer body 12. The cooler 20 can be controlled within a prescribed temperature range, and in the present embodiment, for example, it is controlled to 40° C. By cooling the intermediate transfer body 12 on which the aggregation treatment agent layer has been formed by heating and drying by the heating unit 18, to approximately 40° C. by means of the cooler 20, the radiated heat from the intermediate transfer body 12 is reduced, and the drying of the ink in the nozzles of the head in the print unit 22 is suppressed.

The print unit 22 disposed after the cooler 20 includes liquid ejection heads (hereinafter, referred to as "heads") 22Y, 22M, 22C and 22K of an inkjet type which correspond to the respective ink colors of yellow (Y), magenta (M), cyan (C) and black (K).

The pigment-based inks of respective colors (C, M, Y, K) are ejected from the respective heads 22Y, 22M, 22C and 22K of the print unit 22 onto the aggregation treatment agent layer on the intermediate transfer body 12 which has passed through the cooler 20, in accordance with the image signal, thereby depositing droplets of the inks onto the aggregation treatment agent layer. In the case of the present embodiment, the ink ejection volume achieved by the respective heads 22Y, 22M, 22C and 22K is approximately 2 pl, and the recording density is 1200 dpi in both the main scanning direction (the breadthways direction of the intermediate transfer body 12) and the sub-scanning direction (the conveyance direction of the intermediate transfer body 12). The ink can also contain a polymer resin (micro-particles) having film forming properties, and in the case of this mode, the rub resistance and storage stability are improved in the transfer step and the fixing step.

When ink droplets are deposited onto the aggregation treatment agent layer, then the contact surface between the ink and the aggregation treatment agent layer has a prescribed surface area when the ink deposits, due to a balance between the propulsion energy and the surface energy. An aggregating reaction starts immediately after the ink has deposited on the aggregation treatment agent, and the aggregating reaction starts from the contact surface between the ink and the aggregation treatment agent layer. Since the aggregating reaction occurs only in the vicinity of the contact surface, and the coloring material in the ink aggregates while receiving an adhesive force in the prescribed contact surface area upon deposition of the ink, then movement of the coloring material is suppressed.

Even if another ink droplet is deposited adjacently to this ink droplet, since the coloring material of the previously deposited ink will already have aggregated, then the coloring material does not mix with the subsequently deposited ink, and therefore bleeding is suppressed. After aggregation of the coloring material, the separated ink solvent spreads, and a liquid layer containing dissolved aggregation treatment agent is formed on the intermediate transfer body 12.

As described above, an aggregate of the pigment is formed due to an aggregating reaction of the ink deposited onto the aggregation treatment agent layer, and this aggregate separates from the solvent. The solvent (residual solvent) component which has separated from the pigment aggregate is removed from the intermediate transfer body 12 by a solvent removal roller 42 of a solvent removal unit 24 which is disposed to the downstream side of the print unit 22.

The solvent removal roller 42 used here is desirably a roller which traps liquid in surface grooves (cells) by means of a similar principle to the gravure roller used for application. The liquid collected by the solvent removal roller 42 is removed from the solvent removal roller 42 by means of an air blower or liquid spraying action, or the like.

In this way, in a mode where solvent on the image forming surface 12A of the intermediate transfer body 12 is removed by means of a solvent removal roller 42, since the solvent on the intermediate transfer body 12 is removed appropriately, then there is no transfer of large quantities of solvent (dispersion medium) onto the recording medium 14 in the transfer unit 26. Hence, even in a case where a normal paper, or the like, is used as the recording medium 14, it is possible to prevent problems which are characteristic of water-based solvents, such as curling, cockling, or the like.

Moreover, by removing excess solvent from the ink aggregate by means of the solvent removal unit 24, the ink aggregate is condensed and the internal aggregating force is enhanced yet further. Consequently, adhesion of the resin particles contained in the ink aggregate is promoted effectively, and a stronger internal aggregating force can be applied to the ink aggregate, up until the transfer step carried out by the transfer unit 26. Moreover, by achieving effective condensation of the ink aggregate by removal of the solvent, it is possible to apply good fixing properties and good luster to the image, even after transfer of the image to the recording medium 14.

It is not absolutely necessary to remove all of the solvent on the intermediate transfer body 12 by means of this solvent removal unit 24. If the ink aggregate is condensed excessively by removing an excessive amount of solvent, then the aggregating force between the ink aggregate and the transfer body becomes too strong, and therefore a very large pressure is needed for transfer, which is not desirable. Rather, in order to maintain a viscous elasticity which is suitable for transfer, it is desirable to leave a small amount of solvent.

Moreover, the following beneficial effects are obtained by leaving a small amount of solvent on the intermediate transfer body 12. Specifically, since the ink aggregate is hydrophobic, and the non-volatile solvent component (principally, the organic solvent, such as glycerine) is hydrophilic, then the ink aggregate and the residual solvent component separate after carrying out solvent removal, and a thin layer of liquid composed of the residual solvent component is formed between the ink aggregate and the intermediate transfer body. Consequently, the adhesive force of the ink aggregate on the intermediate transfer body 12 becomes weak, which is beneficial for improving transfer characteristics.

Since the volume of ink ejected as droplets onto the intermediate transfer body 12 varies in accordance with the image to be printed, then in the case of an image having a large white area (an image having a low ink volume), a mist spray is emitted from a mist spray nozzle 43 in order to supplement the low ink volume, in such a manner that the amount of water on the intermediate transfer body 12 is stabilized within a prescribed tolerable range.

A soiling determination sensor 44 for determining the soiling of the intermediate transfer body 12, and a pre-heater 46 forming a preliminary heating device are provided to the downstream side of the solvent removal unit 24 and before the transfer unit 26, in terms of the conveyance direction of the intermediate transfer body. The pre-heater 46 according to the present embodiment is disposed on the rear surface 12B side of the intermediate transfer body 12, and hence the intermediate transfer body 12 on which the primary image has been formed is heated from the rear surface 123 side.

The heating temperature range of the pre-heater 46 is 90° C. through 130° C., and thus it is set to be not less than the heating temperature of the transfer unit 26 during transfer (in the present embodiment, 90° C.). Since the image formed on the intermediate transfer body 12 is transferred to the recording medium 14 in the transfer unit 26 after preliminarily heating the image forming region of the intermediate transfer body 12, then it is possible to set the heating temperature of the transfer unit 26 to a lower temperature than in a case where preliminary heating is not carried out, and furthermore, it is possible to shorten the transfer time of the transfer unit 26.

The transfer unit 26 is constituted of a transfer roller 36 including a heater (not shown in FIG. 1, and indicated by reference numeral 289 which represents a plurality of heaters, in FIG. 17), and a heating roller 48 performing a heating and pressurization nip, which is disposed opposing the transfer roller 36. In this way, a composition is achieved in which the intermediate transfer body 12 and the recording medium 14 are taken up in between the transfer roller 36 and the pressurization roller 48, and are pressurized at a prescribed pressure (nip pressure) while heating to a prescribed temperature, thereby transferring the primary image formed on the intermediate transfer body 12 to the recording medium 14.

The device for adjusting the nip pressure during transfer in the transfer unit 26 is, for example, a mechanism (drive device) which moves the transfer roller 36 or the pressurization roller 48, or both, in the vertical direction in FIG. 1.

A desirable nip pressure during transfer is 1.5 MPa through 2.0 MPa, and a desirable heating temperature (roller temperature) is 80° C. through 120° C. In the present embodiment, the transfer roller 36 and the pressurization roller 48 are both set to 90° C. If the heating temperature during transfer by the transfer roller is set too high, then there may be a problem of deformation of the intermediate transfer body 12, and the like, whereas if, on the other hand, the heating temperature is too low, then there may be a problem of poor transfer characteristics.

Furthermore, if the recording medium 14 is heated in advance (pre-heated) to a temperature of 70° C. through 100° C. in the paper supply unit 28 before transfer, then the transfer characteristics are further improved, which is desirable. In the case of the present embodiment, a heater 50 is provided in the paper supply unit 28 as a preliminary heating device for the recording medium 14. The recording medium 14 which has been preliminarily heated by the heater 50 is conveyed by the nip of the paper supply rollers formed by the pair of adhesive rollers 52 and 53, and is thereby supplied to the transfer unit 26.

The composition of the paper supply unit 28 may be based on a mode using a magazine for rolled paper (continuous paper), or a mode in which paper is supplied by means of a cassette in which cut paper is stacked and loaded, instead of or in combination with magazine for rolled paper. In the case of a configuration in which rolled paper is used, a cutter is provided and the rolled paper is cut to a desired size by the cutter. Alternatively, it is also possible to provide a plurality of magazines and cassettes having different paper widths, paper qualities, and the like.

In the case of a configuration in which a plurality of types of recording medium can be used, it is preferable that an information recording medium such as a bar code and a wireless tag containing information about the type of medium is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

Concrete examples of the recording medium 14 used in the present embodiment are: normal paper (including high-grade paper and recycled paper), permeable media, such as special inkjet paper, non-permeable media or low-permeability media, such as coated paper, sealed paper having adhesive or a detachable label on the rear surface thereof, a resin film, such as an OHP sheet, or a metal sheet, cloth, wood or other types of media.

The recording medium 14 supplied to the transfer unit 26 is heated and pressurized at a prescribed temperature and a prescribed nip pressure by means of the transfer roller 36 and the pressurization roller 48, and the primary image on the intermediate transfer body 12 is transferred onto the recording medium 14. The recording medium 14 (printed object) which has passed through the transfer unit 26 is separated from the intermediate transfer body 12 by means of a separating hook 56, and is output to the exterior of the apparatus by means of a conveyance device (not shown). Although not shown in FIG. 1, a sorter which accumulates the printed objects separately according to print orders, is provided in the printed object output unit.

The recording medium 14 (printed object) which has been separated from the intermediate transfer body 12 may undergo a fixing step (not shown) before being output from the apparatus. The fixing unit is, for example, constituted by a heating roller pair in which the temperature and pressing force can be adjusted. By adding a fixing step of this kind, the polymer micro-particles contained in the ink form a film (namely, a thin film is formed by the polymer micro-particles fusing on the outermost surface of the image), and therefore the rub resistance and storage properties are increased yet further. The heating temperature in the fixing step is 100° C. through 130° C., the pressing force is desirably 2.5 MPa through 3.0 MPa, and these values are optimized in accordance with the temperature characteristics of the added polymer resin (e.g., the film forming temperature: MFT), and the like. Of course, since not only transfer characteristics but also film forming characteristics can be achieved in the transfer step in the transfer unit 26, then it is also possible to adopt a mode in which the fixing unit is omitted.

After the transfer step by the transfer unit 26, the intermediate transfer body 12 which has passed through the detachment unit formed by the separation hook 56 arrives at the first cleaning unit 30.

The first cleaning unit 30 is a device which cleans the intermediate transfer body 12 by using a cleaning liquid obtained by adding a surfactant, or the like, to water, such as distilled water or purified water, or solvent recovered by the solvent removal unit 24. The first cleaning unit 30 is constituted by a cleaning liquid spraying unit 60 which sprays the cleaning liquid, a rotating brush 62 which rotates in a reverse direction with respect to the direction of conveyance of the intermediate transfer body while making contact with the image forming surface 12A of the intermediate transfer body 12, and a blade 64 which slides and wipes the surface of the intermediate transfer body 12. Furthermore, the heater 65 is disposed on the rear surface side of the intermediate transfer body 12 in the first cleaning unit 30. The first cleaning unit 30 principally functions as a device which cleans the intermediate transfer body 12 after completing image transfer to the recording medium 14.

Although the liquid cleaning step performed by using the cleaning liquid in the first cleaning unit 30 is appropriate for high-speed continuous processing, a small amount of residual material is liable to remain on the intermediate transfer body 12, and there are limits on the stable cleaning which can be achieved in the edge portions of the intermediate transfer body 12. Consequently, due to the accumulation of residual material with operation over a long period of time, then problems may occur, such as deterioration in the transfer characteristics and sensitivity, soiling of the apparatus, operational defects, and the like.

Otherwise, if hard dust particles, such as grit particles, become attached to the intermediate transfer body due to the inflow of external air used for cooling the interior of the apparatus, the generation of dust inside the apparatus, or the performance of maintenance work or the like, then this dust may enter in between the wiping members (the rotating brush 62 and the blade 64) during liquid cleaning by the first cleaning unit 30, and it may give rise to damage, such as scratch marks on the intermediate transfer body 12.

From the viewpoint of solving these problems, in the present embodiment, a second cleaning unit 32 is provided which uses an adhesive member (adhesive rollers 66 and 68 for removing dust). The second cleaning unit 32 is constituted by adhesive rollers 66 and 68 which can be moved to control the contact state and the separation state with respect to the surface (12A) of the intermediate transfer body 12, and a cleaning web (or adhesive belt) 70 which is able to make contact with these adhesive rollers 66 and 68. As shown in FIG. 1, this second cleaning unit 32 is disposed at a position opposing the tensioning roller 34A. In FIG. 1, the reference numerals 72 and 73 are pressing rollers.

Either during non-image forming state such as standby state or before liquid cleaning during image formation, the adhesive rollers 66 and 68 are rotated while making contact with the intermediate transfer body 12, and therefore the foreign material on the intermediate transfer body 12 becomes attached to the adhesive rollers 66 and 68, thereby removing the foreign material (dust) from the intermediate transfer body and thus cleaning the surface of the intermediate transfer body.

The foreign material which has become attached to the surface of the adhesive rollers 66 and 68 can be moved to the cleaning web (or the adhesive belt) 70, by separating the adhesive rollers 66 and 68 from the intermediate transfer body 12 and rotating the adhesive rollers 66 and 68 in contact with the cleaning web (or adhesive belt) 70. Consequently, it is possible to clean the surface of the adhesive rollers 66 and 68.

Furthermore, the composition of the principal part of the inkjet recording apparatus 10 will be described in more detail.

Compositional Example of Print Unit

As shown in FIG. 1, the print unit 22 comprises heads 22Y, 22M, 22C, 22K corresponding to the respective colors, provided in the sequence of yellow (Y), magenta (M), cyan (C), black (K), from the upstream side following the conveyance direction of the intermediate transfer body.

The ink storing and loading unit 74 is constituted by an ink tank which stores respective ink liquids which are supplied respectively to the heads 22Y, 22M, 22C and 22K. The ink tanks are connected to the respectively corresponding heads, via prescribed flow channels, and hence the respectively corresponding ink liquids are supplied to the respective heads. The ink storing and loading unit 74 comprises a warning device (for example, a display device or an alarm sound generator) for warning when the remaining amount of any liquid in the tank is low, and has a mechanism for preventing loading errors between different colors.

The inks are supplied from the respective ink tanks of the ink storing and loading unit 74 to the respective heads 22Y, 22M, 22C and 22K, and droplets of the respectively corresponding colored inks are ejected respectively onto the image forming surface 12A of the intermediate transfer body 12, from the respective heads 22Y, 22M, 22C and 22K.

Figure 2:
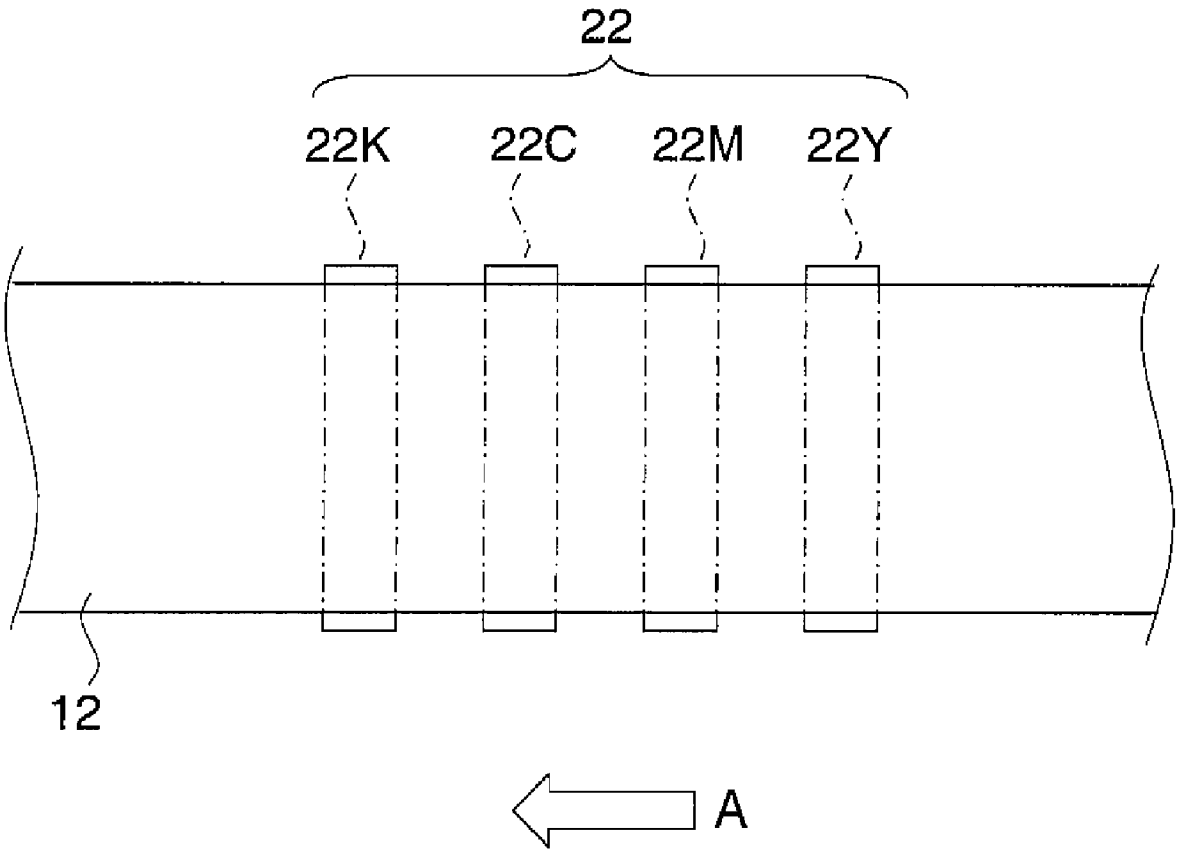
FIG. 2 is a principal plan diagram of the periphery of the print unit.

FIG. 2 is a diagram showing a plan diagram of the print unit 22. As shown in FIG. 2, the respective heads 22Y, 22M, 22C, 22K are each formed as full line type heads, which have a length corresponding to the maximum width of the image forming range of the intermediate transfer body 12, and comprises a nozzle row in which a plurality of nozzles for ejecting ink (not shown in FIG. 1, indicated by reference numeral 81 in FIGS. 3A and 3B) arranged through the full width of the image forming region, provided in the ink ejection surface of the head. The respective heads 22Y, 22M, 22C and 22K are disposed in a fixed position so as to extend in the direction perpendicular to the conveyance direction of the intermediate transfer body.

According to a composition where a full line head having a nozzle row covering the whole width of the intermediate transfer body 12 is provided for each type of ejection liquid, it is possible to form an image (primary image) on the image forming region of the intermediate transfer body 12, by performing just one operation of moving the intermediate transfer body 12 and the print unit 22 relatively in the conveyance direction of the intermediate transfer body 12 (the sub-scanning direction), (in other words, by means of one sub-scanning action). Therefore, it is possible to achieve a higher printing speed compared to a case which uses a serial (shuttle) type of head which moves back and forth reciprocally in the direction perpendicular to the conveyance direction of the intermediate transfer body (main scanning direction; see FIG. 2), and hence it is possible to improve the print productivity.

Although a configuration with the four standard colors of C, M, Y and K is described in the present embodiment, the combinations of the ink colors and the number of colors are not limited to those. Light and/or dark inks, and special color inks can be added as required. For example, a configuration is possible in which ink heads for ejecting light-colored inks, such as light cyan and light magenta, are added, and there is no particular restriction on the arrangement sequence of the heads of the respective colors.

Structure of the Head

Next, the structure of respective heads will be described. The heads 22Y, 22M, 22C and 22K of the respective ink colors have the same structure, and a reference numeral 80 is hereinafter designated to any of the heads.

Figure 3A:
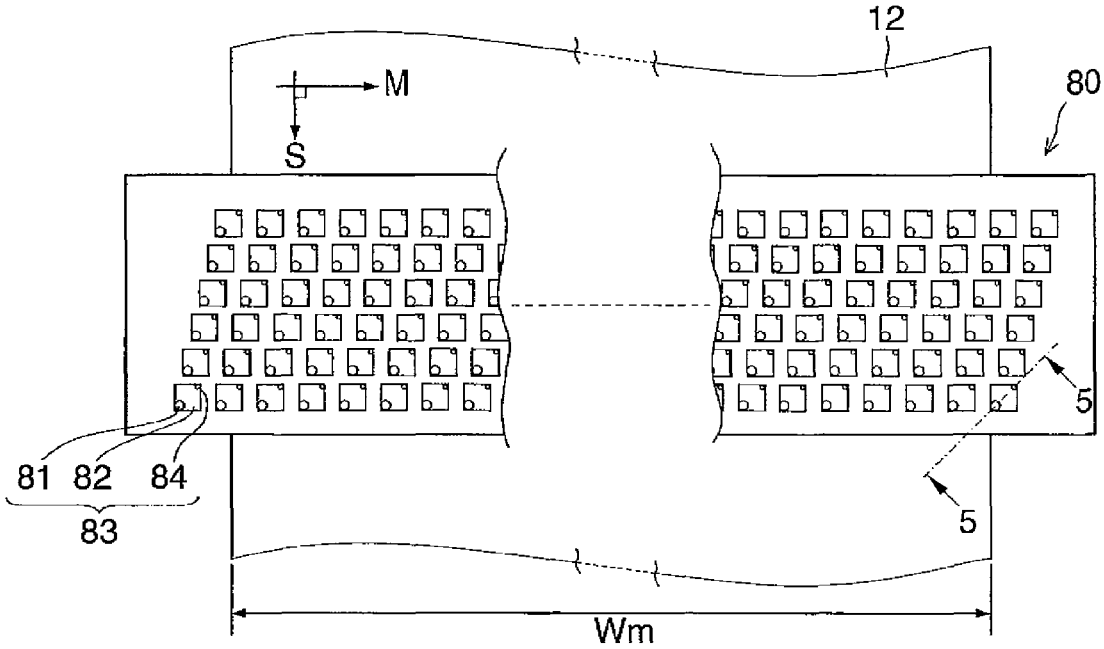
FIGS. 3A and 3B are plan view perspective diagrams showing the internal structure of a head.
Figure 3B:
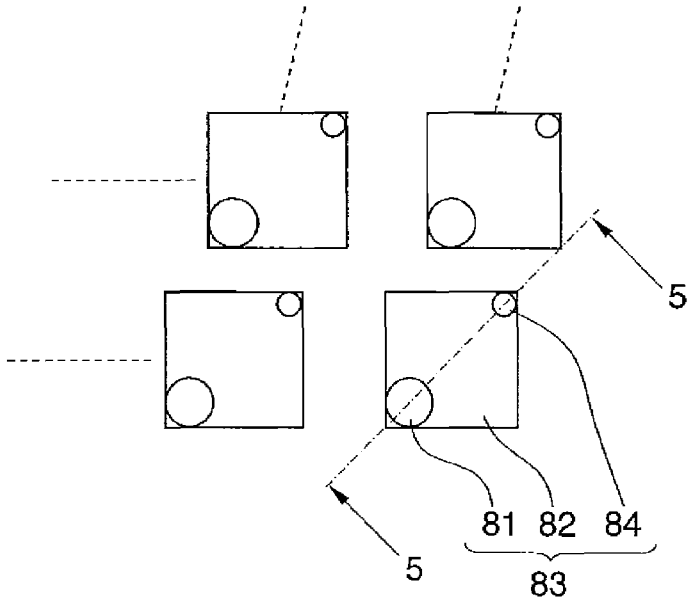

FIG. 3A is a plan view perspective diagram showing an example of the composition of a head 80, and FIG. 3B is an enlarged diagram of a portion of same. In order to achieve a high density of the dot pitch printed onto the surface of the recording medium 14, it is necessary to achieve a high density of the nozzle pitch in the head 80. As shown in FIGS. 3A and 3B, the head 80 according to the present embodiment has a structure in which a plurality of ink chamber units (liquid droplet ejection elements forming recording element units) 83, each including a nozzle 81 forming an ink ejection port, a pressure chamber 82 corresponding to the nozzle 81, and the like, are disposed (two-dimensionally) in the form of a staggered matrix, and hence the effective nozzle interval (the projected nozzle pitch) as projected in the lengthwise direction of the head (the direction perpendicular to the conveyance direction of the intermediate transfer body 12) is reduced (high nozzle density is achieved).

Figure 4:
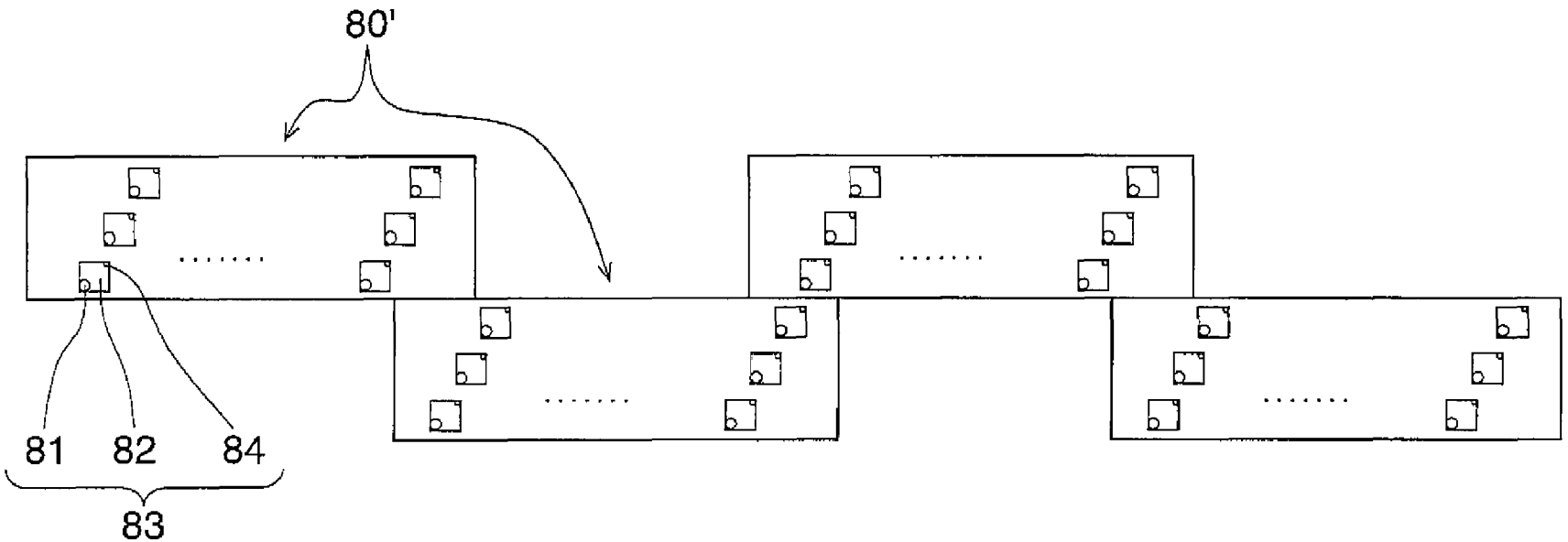
FIG. 4 is a plan diagram showing a further example of the composition of a head.

The mode of composing one or more nozzle rows through a length corresponding to the full width of the image forming region of the intermediate transfer body 12 in the direction, (in other words, in the direction indicated by arrow M in FIGS. 3A and 3B), substantially perpendicular to conveyance direction (arrow S in FIGS. 3A and 3B) of the intermediate transfer body 12, is not limited to the example shown in FIGS. 3A and 3B. For example, instead of the composition in FIG. 3A, as shown in FIG. 4, a line head having nozzle rows of a length corresponding to the entire width of the image forming region of the intermediate transfer body 12 can be formed by arranging and combining, in a staggered matrix, short head modules 80' each having a plurality of nozzles 81 arrayed in a two-dimensional fashion.

As shown in FIGS. 3A and 3B, the planar shape of the pressure chamber 82 provided corresponding to each nozzle 81 is substantially a square shape, and an outlet port to the nozzle 81 is provided at one of the ends of a diagonal line of the planar shape, while an inlet port (supply port) 84 for supplying ink is provided at the other end thereof. The shape of the pressure chamber 82 is not limited to that of the present embodiment and various modes are possible in which the planar shape is a quadrilateral shape (diamond shape, rectangular shape, or the like), a pentagonal shape, a hexagonal shape, or other polygonal shape, or a circular shape, elliptical shape, or the like.

Figure 5:
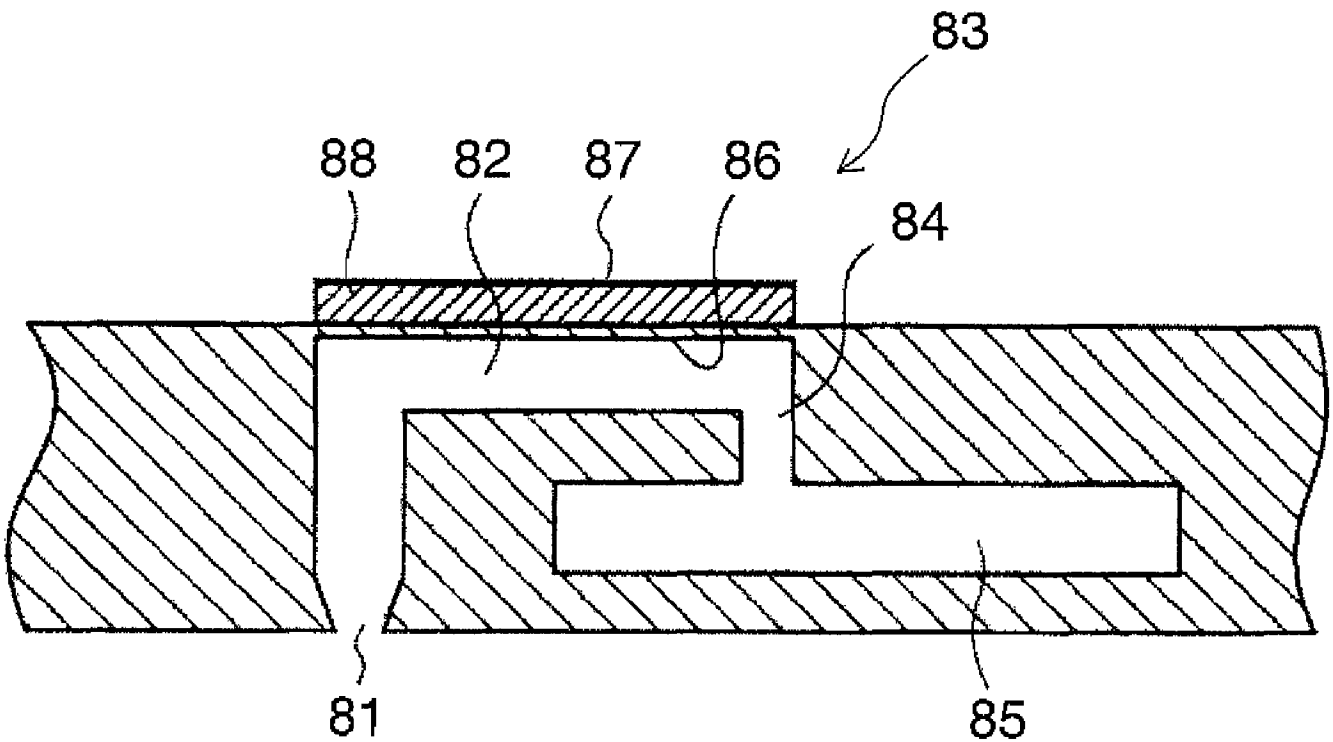
FIG. 5 is a cross-sectional diagram along line 5-5 in FIGS. 3A and 3B.

FIG. 5 is a cross-sectional diagram (along line 5-5 in FIG. 3A) showing the three-dimensional composition of the liquid droplet ejection element of one channel which forms a recording element unit in the head 80 (an ink chamber unit corresponding to one nozzle 81).

As shown in FIG. 5, each pressure chamber 82 is connected to a common flow passage 84 via the supply port 85. The common flow channel 85 is connected to an ink tank (not shown in FIG. 5, but equivalent to reference numeral 74 in FIG. 1), which is a base tank that supplies ink, and the ink supplied from the ink tank is supplied through the common flow channel 85 to the pressure chambers 82.

An actuator 88 provided with an individual electrode 87 is bonded onto a pressure plate (a diaphragm that also serves as a common electrode) 86 which forms the surface of one portion (in FIG. 5, the ceiling) of the pressure chambers 82. When a drive voltage is applied to the individual electrode 87 and the common electrode, the actuator 88 deforms, thereby changing the volume of the pressure chamber 82. This causes a pressure change which results in the ink being ejected from the nozzle 81. For the actuator 88, it is possible to adopt a piezoelectric element using a piezoelectric body, such as lead zirconate titanate, barium titanate, or the like. When the displacement of the actuator 88 returns to its original position after ejecting ink, the pressure chamber 85 is replenished with new ink from the common flow channel 84, via the supply port 82.

By controlling the driving of the actuators 88 corresponding to the nozzles 81 in accordance with the dot data generated from the input image by a digital half-toning process, it is possible to eject ink droplets from the nozzles 81. By controlling the ink ejection timing from the nozzles 81 in accordance with the speed of conveyance of the intermediate transfer body 12, while conveying the intermediate transfer body 12 in the sub-scanning direction at a uniform speed, it is possible to record a desired image (here, a primary image before transfer) onto the intermediate transfer body 12.

Figure 6:
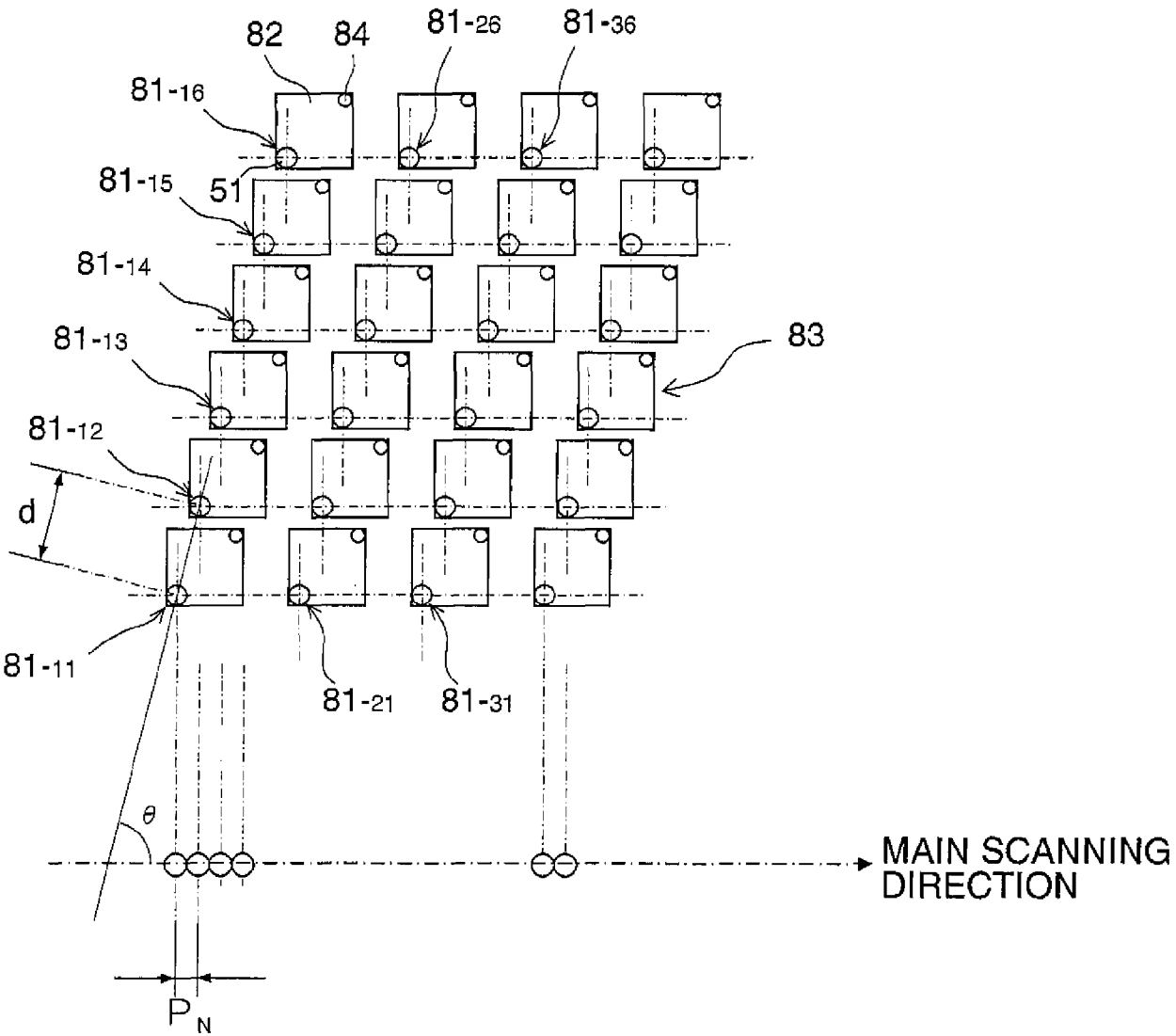
FIG. 6 is a plan diagram showing an example of the arrangement of nozzles in a head.

As shown in FIG. 6, the high-density nozzle head according to the present embodiment is achieved by arranging a plurality of ink chamber units 83 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 83 are arranged at a uniform pitch d in line with a direction forming an angle of θ with respect to the main scanning direction, the pitch P of the nozzles projected (normally) to an alignment in the main scanning direction is $d \times \cos\theta$, and hence it is possible to treat the nozzles 81 as if they were arranged linearly at a uniform pitch of P. By adopting a composition of this kind, it is possible to achieve higher density of the effective nozzle rows when projected to an alignment in the main scanning direction.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the intermediate transfer body 12 (the direction perpendicular to the conveyance direction of the intermediate transfer body 12) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 81 arranged in a matrix such as that shown in FIG. 6 are driven, the main scanning according to the above-described (3) is preferred. More specifically, the nozzles 81-11, 81-12, 81-13, 81-14, 81-15 and 81-16 are treated as a block (additionally; the nozzles 81-21, . . . , 81-26 are treated as another block; the nozzles 81-31, . . . , 81-36 are treated as another block; . . . ); and one line is printed in the width direction of the intermediate transfer body 12 by sequentially driving the nozzles 81-11, 81-12, . . . , 81-16 in accordance with the conveyance velocity of the intermediate transfer body 12.

On the other hand, "sub-scanning" is defined as to repeatedly perform printing of one line (a line formed of a row of dots, or a line formed of a plurality of rows of dots) formed by the main scanning, while moving the full-line head and the intermediate transfer body 12 relatively to each other.

The direction indicated by one line (or the lengthwise direction of a band-shaped region) recorded by main scanning as described above is called the "main scanning direction", and the direction in which sub-scanning is performed, is called the "sub-scanning direction". In other words, in the present embodiment, the conveyance direction of the intermediate transfer body 12 is called the sub-scanning direction and the direction perpendicular to same is called the main scanning direction. In implementing the present invention, the arrangement of the nozzles is not limited to that of the example shown.

Moreover, a method is employed in the present embodiment where an ink droplet is ejected by means of the deformation of the actuator 88, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Preparation of Aggregation Treatment Agent

TREATMENT LIQUID EXAMPLE 1

A treatment liquid (Example 1) is prepared according to the composition shown in Table 1. Thereupon, the physical properties of the treatment liquid (Example 1) thus obtained were measured, and the pH was 3.6, the surface tension was 28.0 mN/m, and the viscosity was 3.1 mPa·s.

TABLE 1

| Material | Weight % |
|---|---|
| 2-pyrrolidone-5-carboxylic acid (made by Tokyo Chemical Industry Co., Ltd.) | 10 |
| Lithium hydroxide-hydride (made by Wako Pure Chemical Industries, Ltd.) | 2 |
| Olfine E1010 (made by Nissin Chemical Industry Co., Ltd.) | 1 |
| Deionized water | 87 |

TREATMENT LIQUID EXAMPLE 2

Moreover, a treatment liquid (Example 2) containing a surfactant is prepared according to the composition shown in Table 2. Thereupon, the physical properties of the treatment liquid (Example 2) thus obtained were measured, and the pH was 3.5, the surface tension was 18.0 mN/m, and the viscosity was 10.1 mPa·s.

TABLE 2

| Material | Weight % |
|---|---|
| 2-pyrrolidone-5-carboxylic acid (made by Tokyo Chemical Industry Co., Ltd.) | 10 |
| Lithium hydroxide-hydride (made by Wako Pure Chemical Industries, Ltd.) | 2 |
| Olfine E1010 (made by Nissin Chemical Industry Co., Ltd.) | 1 |

TABLE 2-continued

| Material | Weight % |
|---|---|
| Fluorine surfactant 1 | 3 |
| Deionized water | 84 |

The chemical formula of the fluorine surfactant 1 used in (Table 2) is as follows.

(C 1)

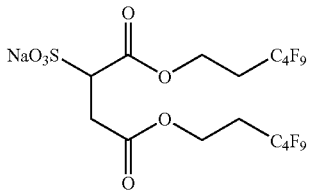

Preparation of Ink

An example of the preparation of an ink used in the present embodiment is described below.

<Preparation of (Polymer Dispersion) Cyan Ink>

A solution comprising 6 parts by weight of styrene, 11 parts by weight of stearyl methacrylate, 4 parts by weight of styrene macromer AS-6 (made by Toa Gosei Co., Ltd.), 5 parts by weight of "Premmer" PP-500 (made by NOF Corp.), 5 parts by weight of methacrylic acid, 0.05 parts by weight of 2-mercaptoethanol, and 24 parts by weight of methylethyl ketone was prepared in a reaction vessel.

On the other hand, a mixed solution was prepared by introducing, into a titration funnel, 14 parts by weight of styrene, 24 parts by weight of stearyl methacrylate, 9 parts by weight of styrene macromer AS-6 (made by Toa Gosei), 9 parts by weight of "Premmer" PP-500 (made by NOF Corp.), 10 parts by weight of methacrylic acid, 0.13 parts by weight of 2-mercapotoethanol, 56 parts by weight of methylethyl ketone, and 1.2 parts by weight of 2,2'-azobis(2,4-dimethyl valeronitrile).

Thereupon, the mixed solution inside the reaction vessel was raised to a temperature of 75° C. while being agitated, in a nitrogen atmosphere, and the mixed solution in the titration funnel was gradually added by titration over a period of one hour. When two hours had passed after the end of titration, a solution obtained by dissolving 1.2 parts by weight of 2,2'-azobis(2,4-dimethyl valeronitrile) in 12 parts by weight of methylethyl ketone was added by titration over a period of 3 hours, and the mixture was matured for a further two hours at 75° C. and two hours at 80° C., thereby yielding a polymer dispersant solution.

A portion of the polymer dispersant solution thus obtained was separated by removing the solvent, and the resulting solid component was diluted to 0.1 wt % with tetrahydrofuran, and then measured with a high-speed GPC (gel permeation chromatography) apparatus HLC-82220GPC, using three sequential columns: TSKgel Super HZM-H, TSKgel Super HZ4000, TSKgel Super HZ2000. The weight-average molecular weight was 25,000, when indicated as the weight of a polystyrene molecule.

5.0 g, by solid conversion, of the obtained polymer dispersant, 10.0 g of the cyan pigment, Pigment Blue 15:3 (made by Dainichiseika Color and Chemicals Mfg.), 40.0 g of methylethyl ketone, 8.0 g of 1 mol/L sodium hydroxide, 82.0 g of deionized water, and 300 g of 0.1 mm zirconia beads were supplied to a vessel, and dispersed for 6 hours at 1000 rpm in a "Ready Mill" dispersion machine (made by IMEX). The dispersion thus obtained was condensed at reduced pressure in an evaporator until the methyl ethyl ketone had been sufficiently removed, and the pigment density become 10%. The pigment particle size of the cyan dispersion liquid thus obtained was 77 nm.

Using this cyan dispersion, an ink was prepared to achieve the composition shown in Table 3, and the prepared ink was then passed through a 5 μm filter to remove coarse particles, thereby obtaining a cyan ink (C1-1). Thereupon, the physical properties of the cyan ink C1-1 thus obtained were measured, and the pH was 9.0, the surface tension was 32.9 mN/m, and the viscosity was 3.9 mPa·s.

TABLE 3

| Material | Weight % |
|---|---|
| Cyan pigment (Pigment Blue 15:3) made by Dainichiseika Color and Chemicals Mfg Co., Ltd. | 4 |
| Polymer dispersant | 2 |
| Latex LX-2 | 8 |
| Glycerine (made by Wako Pure Chemical Industries Co., Ltd.) | 20 |
| Diethylene glycol (made by Wako Pure Chemical Industries Co., Ltd.) | 10 |
| Olfine E1010 (made by Nissin Chemical Industry Co., Ltd.) | 1 |
| Deionized water | 65 |

Magenta, yellow and black inks were also prepared in a similar fashion to the above.

Additional Polymer

Particles of a polymer resin, or the like, are added to the treatment liquid (aggregation treatment liquid) and ink described above, as appropriate. In the treatment liquid, it is desirable to introduce particles having a particle size of 1 μm through 5 μm and a melting point of 60° C. through 120° C., in order to stabilize the coloring material and improve transfer performance, whereas in the ink, it is desirable to introduce particles having a particle size of 1 μm or less and a glass transition point of 40° C. through 60° C., at a ratio of 1% through 5%, in order to fix the image. A compositional example is shown in Table 4.

TABLE 4

| Category | Composition | Particle diameter [μm] | Tg [° C.] | MFT [° C.] | Tm [° C.] |
|---|---|---|---|---|---|
| Aggregation treatment agent (LX-1) | Low-molecular-weight ethylene | 4 | — | — | 110 |
| | Low-molecular-weight ethylene | 1 | — | — | 110 |
| | Paraffin wax | 0.3 | — | — | 66 |
| Ink (LX-2) | Acrylic | 0.12 | 47 | 65 | — |
| | Styrene acrylic | 0.07 | 49 | 46 | — |

Tg: glass transition point;
Tm: melting point

Composition of Treatment Liquid Application Unit

<First Compositional Example of Liquid Application Apparatus>

Figure 7:
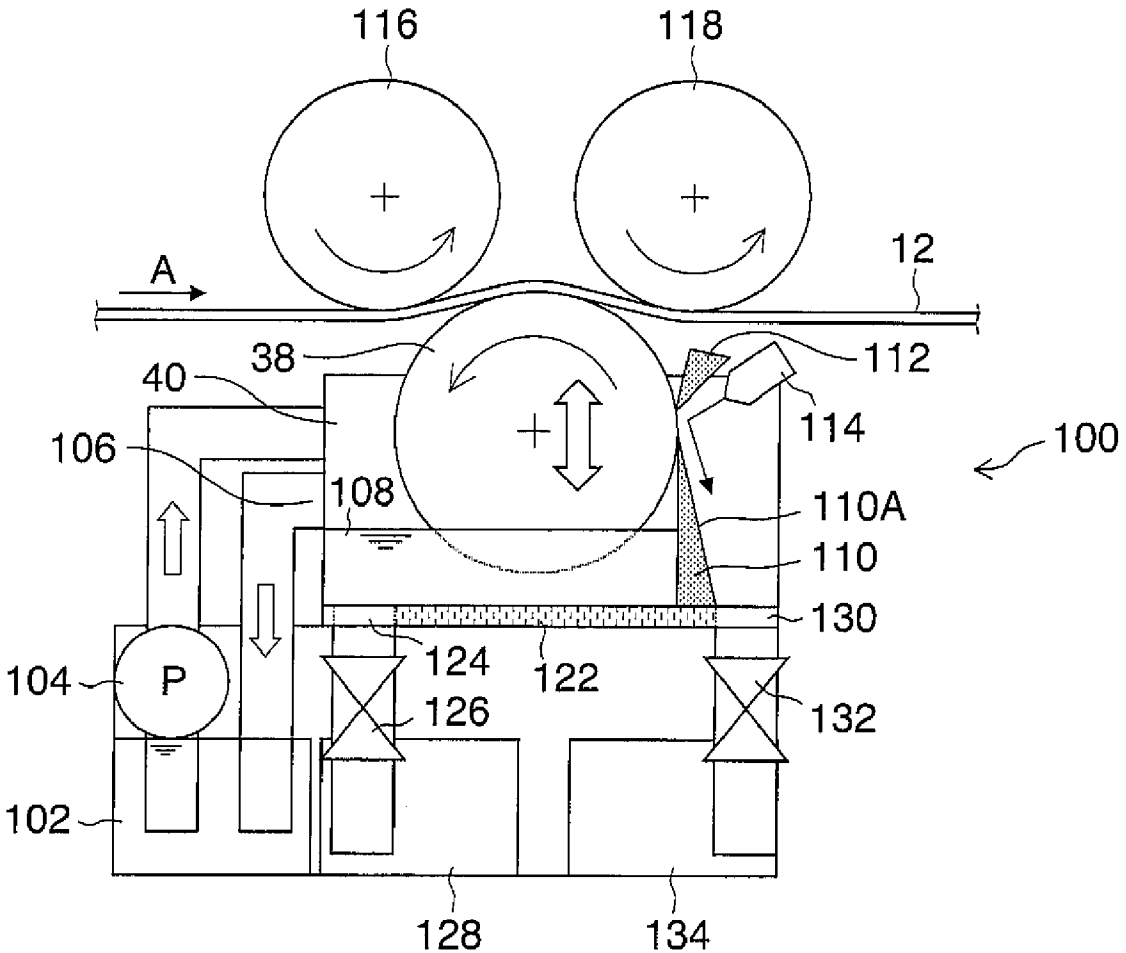
FIG. 7 is a compositional diagram showing a first embodiment of a liquid application apparatus used in a treatment liquid application unit.

FIG. 7 is a compositional diagram showing a liquid application apparatus according to a first compositional example used in the treatment liquid coating unit 16. In FIG. 7, the intermediate transfer body 12 is conveyed from the left-hand side toward the right-hand side. The liquid application apparatus 100 shown in FIG. 7 is an apparatus which applies treatment liquid selectively to a prescribed region of the intermediate transfer body 12, by pressing the gravure roller 38 against the intermediate transfer body 12 which is being conveyed, and driving the gravure roller 38 to rotate at a prescribed uniform speed in the opposite direction (namely, in the counter-clockwise direction in FIG. 7) of the direction of conveyance of the intermediate transfer body 12. In the present embodiment, the liquid application apparatus 100 controls the application region in conveyance direction of the intermediate transfer body.

In the liquid application apparatus 100 according to the present embodiment, the treatment liquid is suctioned up by a supply pump 104 from a treatment liquid supply tank 102 which stores the treatment liquid, and the treatment liquid is introduced into a treatment liquid container 40. A drain flow channel 106 is provided at a prescribed height above the lower surface of the treatment liquid container 40, and since overflowing liquid is returned to the treatment liquid supply tank 102 via the drain flow channel 106, then the height of the liquid surface of the treatment liquid 108 in the treatment liquid container 40 is kept at a uniform height.

Figure 8A:
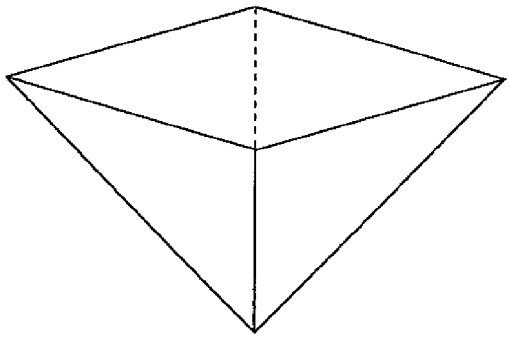
FIGS. 8A and 8B are diagrams showing an example of the cell shape formed on the surface of the gravure roller.
Figure 8B:
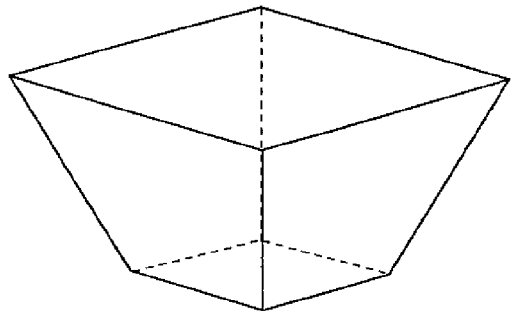

The gravure roller 38 is an application roller in which a plurality of highly precise cells (see FIGS. 8A and 8B) are cut into the surface of the roller at a prescribed density, in a pyramid shape, or lattice shape (truncated square cone shape). The gravure roller 38 has a length (width dimension) which is not less than the width dimension of the application receiving surface of the intermediate transfer body 12. There are no particular restrictions of the mode of arrangement of the cells on the roller surface, and a desirable mode is one in which the cells are aligned in an oblique direction which is not perpendicular to the direction of rotation. The shape, depth, volume and density of the cells are determined appropriately in accordance with the amount of liquid which is to be applied (the thickness of the liquid film after application). The gravure roller may also be called an anilox roller, or a precision roller.

As indicated in FIG. 7, a portion of the gravure roller 38 (the portion on the lower side in FIG. 7) is immersed in the treatment liquid 108 stored in the treatment liquid container 40, and therefore the treatment liquid enters inside the cells and the treatment liquid adheres to the surface of the roller.

A squeegee blade 110 is erected inside the treatment liquid container 40 as a device for wiping away an excess of the treatment liquid from the surface of the gravure roller 38. The front end portion of the squeegee blade 110 is disposed so as to contact the gravure roller 38, and this front end portion is impelled in a direction which presses against the circumferential surface of the gravure roller 38. This impelling force may be caused by the elastic deformation of the squeegee blade 110 itself, or it may be applied from an external source by using a spring or other impelling member (not shown).

By wiping away the excess of the treatment liquid with the squeegee blade 110, while rotating the gravure roller 38 which has been immersed in the treatment liquid 108, only the treatment liquid which is held inside the cells remains on the gravure roller 38 after the action of the squeegee blade 110.

Furthermore, in the present embodiment, from the viewpoint of controlling the application range of the treatment liquid in the direction of conveyance of the intermediate transfer body 12, in the liquid application apparatus 100, a shielding member 112 is disposed to the downstream side of the squeegee blade 110 in terms of the direction of rotation of the gravure roller 38, so as to narrow (restrict) the opening range of the surface of the gravure roller 38 in the direction of rotation, and furthermore, a substitute fluid spraying unit 114 is provided which sprays a liquid, such as water, or a gas such as air (below, these are referred to jointly as "substitute fluid"), from an oblique upward direction as shown in FIG. 7, onto the surface of the gravure roller 38 which is exposed between the shielding member 112 and the squeegee blade 110 (namely, in the opening range described above).

The substitute fluid spraying unit 114 has a spraying range whereby a substitute fluid is sprayed onto the whole width of the gravure roller 38. By spraying a substitute fluid from the substitute fluid spraying unit 114, the treatment liquid is removed from the cells of the gravure roller 38. In other words, if a liquid is used as a substitute fluid, then the treatment liquid in the cells is substituted with the liquid of the substitute fluid. On the other hand, if gas is used, such as an air spray, for instance, then the treatment liquid is blown away from inside the cells (the treatment liquid is substituted with air).

By controlling the range in which the treatment liquid is removed from the gravure roller 38 by spraying a substitute fluid, it is possible to control the application range of the treatment liquid on the intermediate transfer body 12 (the region in the direction of conveyance of the intermediate transfer body). By spraying the substitute fluid selectively onto the range corresponding to the non-image forming unit on the intermediate transfer body 12, the treatment liquid is not applied onto the non-image forming sections on the intermediate transfer body 12, and therefore the treatment liquid can be applied only onto the image forming section thereof (see FIG. 16).

According to this mode, it is possible to control application of the treatment liquid onto unwanted regions, and even when the image is transferred onto the cut paper, it is possible to prevent the aggregation treatment liquid to adhere to the pressurization roller 48. Consequently, the operation of the apparatus is stabilized, and the reliability over time in terms of soiling and corrosion is improved.

It is desirable if a liquid-repelling treatment is provided on the surface of the gravure roller 38 (and in particular, the recess sections thereof), such as an electroless PTFE (polytetrafluoroethylene) eutectic plating or PFA (paraformaldehyde) coating, thereby setting the surface energy to approximately 25 mN/m (=mJ/m$^2$) through 40 mN/m, since this improves the mold separating characteristics of the aggregation treatment agent, and since the surface tension of the aggregation treatment agent is a low value of 18 mN/m (=mJ/m$^2$) through 28 mN/m (see Table 1 and Table 2), then it is also possible to ensure good application characteristics.

Although a desirable mode is one in which the rotational drive device of the gravure roller 38 (not shown) uses direct drive by an inverter motor (direct shaft coupling), it is not limited to this mode, and it is also possible to use a combination of various types of motor and a reduction gear device, or a combination of various types of motor and a wound transmission device, such as a timing belt.

Moreover, the gravure roller 38 is supported movably in the vertical direction in FIG. 7 by means of a movement mechanism (abutment/separation mechanism), which is not shown in FIG. 7, and therefore it can be controlled and switched between a state where the gravure roller 38 is pressed against the intermediate transfer body 12 (the nip state shown in FIG. 7), and a state where it has been separated (retracted) from the intermediate transfer body 12.

The pressing rollers 116 and 118 are disposed on the opposite side of the gravure roller 38 (the upper side in FIG. 7), via the intermediate transfer body 12. The two pressing rollers 116 and 118 are disposed in parallel alignment at a prescribed interval apart in the conveyance direction of the intermediate transfer body 12, and the gravure roller 38 is disposed approximately at the midpoint between the two pressing rollers 116 and 118 in the direction of conveyance of the intermediate transfer body 12.

As shown in FIG. 7, during application, the gravure roller 38 is pressed against the intermediate transfer body 12, and the intermediate transfer body 12 is pressed up between the pressing rollers 116 and 118. The intermediate transfer body 12 between the pressing rollers 116 and 118 is bent so as to follow the upper circumferential surface of the gravure roller 38, and hence the contact with respect to the gravure roller 38 is improved and the contact surface area can also be guaranteed. By controlling the amount by which the gravure roller 38 is pressed against the intermediate transfer body 12, it is possible to adjust the angle of bending of the intermediate transfer body 12 with respect to the gravure roller 38.

By conveying the intermediate transfer body 12 at a uniform speed in this nipped state and causing the gravure roller 38 to rotate in reverse with respect to the direction of conveyance of the intermediate transfer body, a thin film having a uniform film thickness can be applied to the image forming surface 12A of the intermediate transfer body 12 which forms the liquid application receiving member. In this case, the pressing rollers 116 and 118 rotate in a direction of rotation which follows the direction of conveyance, in accordance with the conveyance of the intermediate transfer body 12. Furthermore, by separating the gravure roller 38 when not performing application, for instance, during standby, cleaning by the first cleaning unit 30 or the second cleaning unit 32 can be carried out stably, and damage to the intermediate transfer body 12 can be reduced.

In the liquid application apparatus 100 according to the present embodiment, in particular, if the density of the cells in the gravure roller 38 is set to 100 through 250 lines per inch, then the visibility of the application pattern is low, and a thin film can be applied to a uniform application thickness of approximately 1 μm through 25 μm. Moreover, if the density of the cells is set to 150 through 200 lines per inch, then it is possible to form a uniform liquid film having a thickness of approximately 2 μm through 10 μm, and hence there is no flow of liquid on the intermediate transfer body, which is even more desirable since it produces good fixing properties when ink droplets are deposited.

Figure 8C:
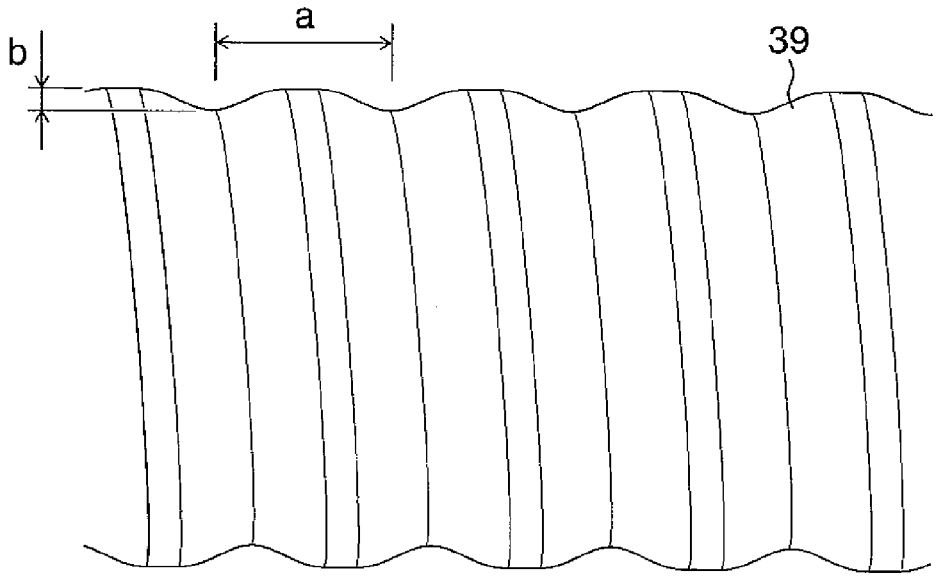
FIG. 8C is a diagram showing an example of a spiral roller.

The application member is not limited to being a gravure roller 38, and as shown in FIG. 8C, it is also possible to use a spiral roller 39 having spiral-shaped grooves formed in the surface thereof (for example, a coating bar, or commonly known wire bar, such as "D-Bar" (trade name) made by OSG Corp.) The shape, pitch "a" and depth "b" of the grooves in the spiral roller 39 are selected appropriately in accordance with the amount (the thickness of the liquid film after application) of liquid that is to be applied. For example, in the case of the liquid application apparatus 100 according to the present embodiment, a suitable spiral roller is one having a pitch a=0.08 mm through 0.2 mm, and a groove depth b=5 μm through 20 μm.

Moreover, in the liquid application apparatus 100 according to the present embodiment, the squeegee blade 110 and the substitute fluid spraying unit 120 are disposed in such a manner that the treatment liquid which has been removed by spraying of the substitute fluid flows and drops in substantially the downward direction along the squeegee blade 110, from the spraying position. In other words, in FIG. 7, the front end portion of the squeegee blade 110 abuts against approximately the three o'clock position on the gravure roller 38, and the liquid removed from the gravure roller 38 (if the substitute fluid is a liquid, then the removed liquid also is mixed liquid of the treatment liquid and the substitute fluid) by the substitute fluid which is sprayed onto the region between the squeegee blade 110 and the shielding member 112 flow down substantially in the direction of gravity, along the inclined surface 110A of the squeegee blade 110. By this means, liquid is prevented from being accumulated at the front end portion of the squeegee blade 110, and scattering of the removed liquid can be prevented, while improving the controllability of the liquid removal process.

Furthermore, the squeegee blade 110 according to the present embodiment, also serves as a dividing member (partitioning member) which demarcates the interior of the treatment liquid container 40. In FIG. 7, the region to the left-hand side of the squeegee blade 110 is the region where the treatment liquid 108 is stored (a portion which functions as an application liquid receptacle), and the region to the right-hand side of the squeegee blade 110 is a collection region for collecting the liquid which has been removed by means of the substitute fluid. A heater 122 for heating the treatment liquid is provided in the bottom portion of the region of the treatment liquid container 40 where the treatment liquid 108 is stored, and a treatment liquid outlet port 124 is also formed in this region. The treatment liquid outlet port 124 is connected via a treatment liquid discharge valve 126 to a treatment liquid collection tank 128.

When the treatment liquid discharge valve 126 is opened, it is possible to remove the treatment liquid 108 from the treatment liquid container 40, and by driving the liquid supply pump 104 with the treatment liquid discharge valve 126 closed, it is possible to incorporate the treatment liquid 108 into the treatment liquid container 40.

On the other hand, a removed liquid outlet port 130 is formed in the bottom portion of the collection region for the removed liquid, which is demarcated by the squeegee blade 110, and this removed liquid outlet port 13 0 is connected via a removed liquid discharge valve 132 to a removed liquid collection tank 134.

In this way, by forming a partition by means of the squeegee blade 110, it is possible to separate the aggregation treatment liquid and the removed liquid, as well as independently collecting the removed liquid. If air is used as the substitute fluid, then it is possible to remove the liquid by means of a simple composition, and furthermore, since the small amount of surfactant or high-boiling-point solvent left on the intermediate transfer body 12 after passing through the first cleaning unit 30 (see FIG. 1) acts as a lubricant, then it is possible to prevent damage to the intermediate transfer body 12, even in cases where the application liquid on the surface of the roller has been removed by using air. Moreover, it is also possible to take the liquid colleted as the removed liquid, and to reuse it as the treatment liquid for application.

On the other band, if liquid or a liquid mist is used as the substitute fluid, then the lubricating effect is enhanced, and in particular, if water, such as purified water, is used, then the aggregation treatment agent is effectively diluted and washed away, and in the case of an intermediate transfer body 12 having a low surface energy of approximately 15 mN/m through 30 mN/m (=mJ/m$^2$) as described above, the amount of aggregation treatment agent left adhering to the intermediate transfer body 12 is small, the intermediate transfer body 12 can be dried in an aggregation treatment agent heating unit, and therefore even more stable removal can be achieved.

Figure 9:
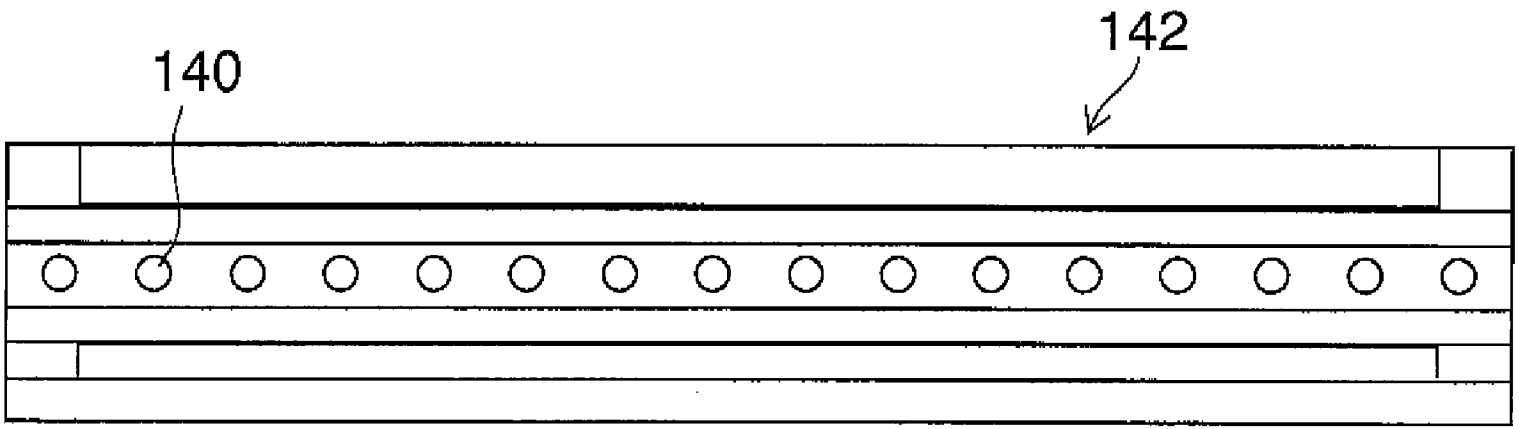
FIG. 9 is a compositional diagram of a line spray showing one example of a spraying member used in a substitute fluid spraying unit.
Figure 10:
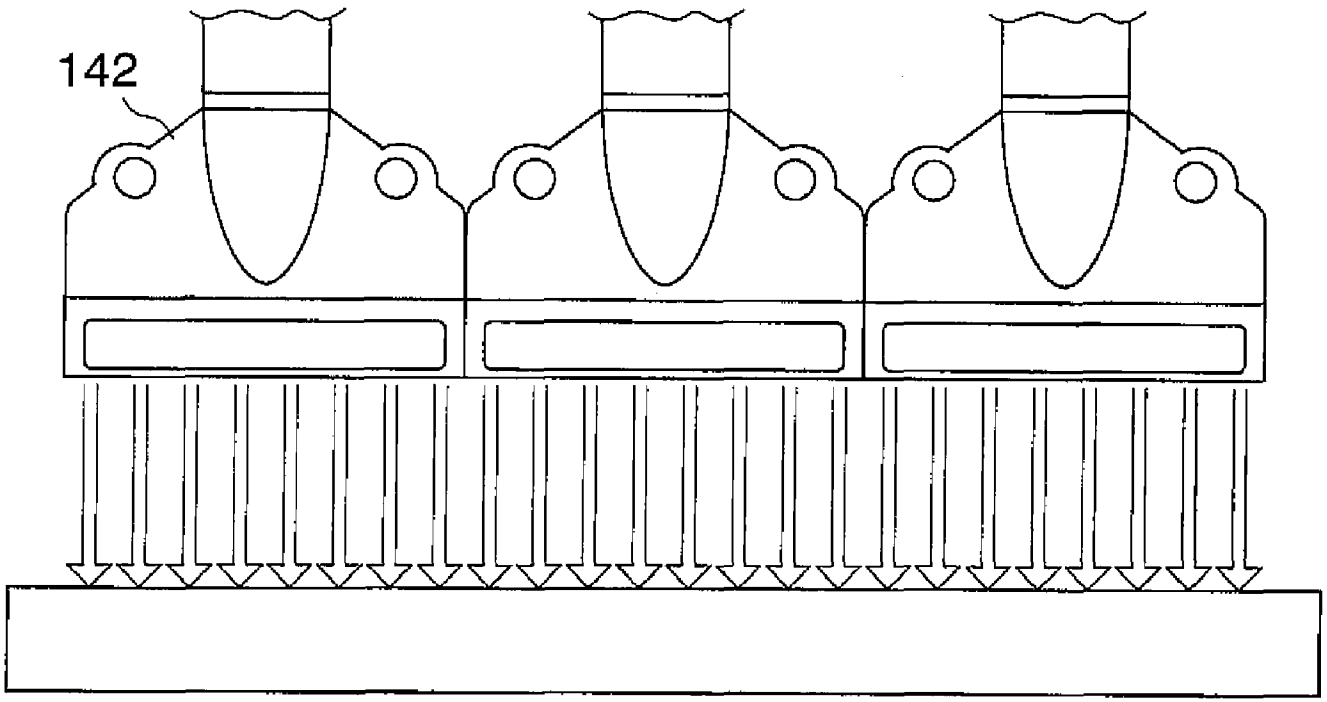
FIG. 10 is a diagram showing one example of the use of a line spray.

To give one example of a spraying member used in the substitute fluid spraying unit 114, in the case of an air spray, as shown in FIG. 9, a line spray 142 can be used in which nozzles 140 having a diameter of approximately 0.5 mm through 1 mm are arranged in the breadthways direction of a spraying surface, at a pitch of 1 mm through 3 mm. By arranging a plurality of line sprays 142 of this kind as shown in FIG. 10, a prescribed spray width is achieved, and a substantially uniform impact force of 500 mN through 1500 mN can be applied to the whole of the surface receiving the spray, in a pressure range of 0.1 MPa through 0.5 MPa.

Figure 11:
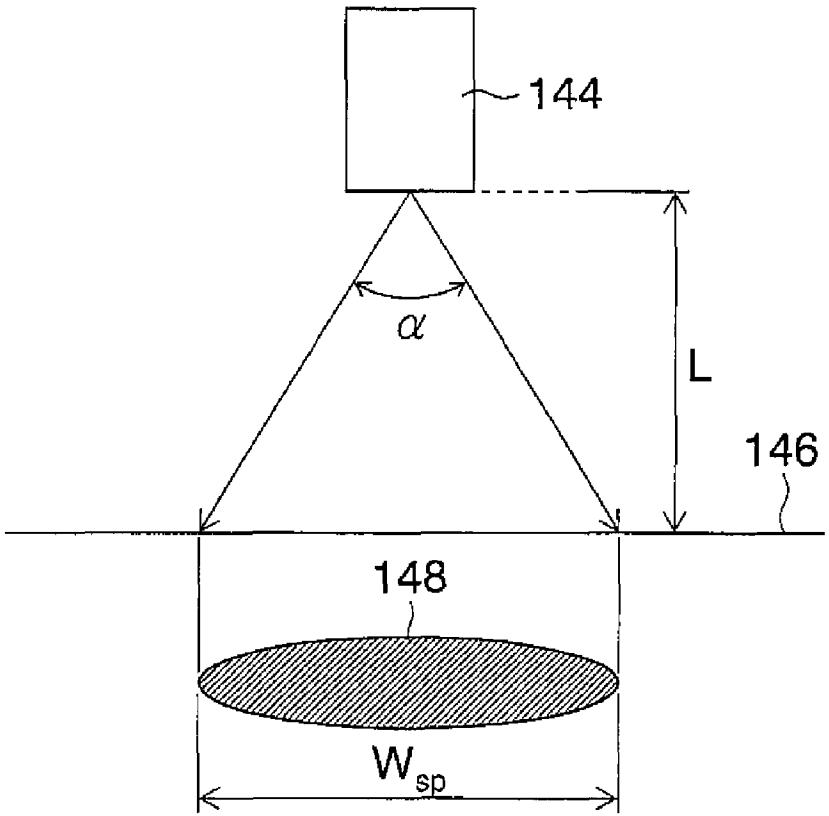
FIG. 11 is an illustrative diagram of a flat spray nozzle.

Furthermore, in the case of a liquid spray, for example, it is possible to use a single-fluid flat spray nozzle having an orifice diameter of approximately 0.2 mm through 0.6 mm and a spray angle of 60° to 100°. As shown in FIG. 11, since the flat spray nozzle sprays fluid at a spray angle of $\alpha$, then the effective spray width $W_{sp}$ of the spray range 148 is governed by the distance L between the ejection surface of the nozzle body 144 and the spray receiving surface 146. The flat spray nozzle is not limited to a mode where a single nozzle is used, and it is also possible to use a plurality of flat spray nozzles arranged in the breadthways direction of the gravure roller 38. In this case, it is possible to control the removal process in the headthways direction, as well as the conveyance direction.

According to the inkjet recording apparatus 10 which comprises the liquid application apparatus 100 according to the present embodiment, when the apparatus is halted or at standby, the treatment liquid discharge valve 126 is opened, the treatment liquid 108 is removed from the treatment liquid container 40, thereby ending the immersed state of the gravure roller 38, and the gravure roller 38 is then caused to rotate while spraying the substitute fluid for a prescribed period of time. Thereby, the treatment liquid is removed reliably from the roller surface, thus preventing solidification of residual treatment liquid or modification of the roller surface due to the residual treatment liquid, and hence stable operation of the apparatus can be achieved.

<Second Compositional Example of Liquid Application Apparatus>

Next, a second compositional example of the liquid application apparatus used in the treatment liquid application unit 16 will be described. The spray angle of the single-fluid flat spray nozzle described above can be controlled by adjusting the spray pressure. Furthermore, even if using a pressurized two-fluid flat spray nozzle (a two-fluid air atomizing nozzle) which sprays minute particles created by mixing air and liquid, it is also possible to control the spray angle by controlling a combination of the air pressure and the liquid flow rate.

It is possible to apply the treatment liquid to the gravure roller by using a spray nozzle which has a variable spray angle in this way. In so doing, it is possible to adjust not only the application range of the treatment liquid in the conveyance direction of the intermediate transfer body but also the application width of the treatment liquid in the breadthways direction which is perpendicular to the conveyance direction, without having to arrange a plurality of removal nozzles in the breadthways direction.

Figure 12:
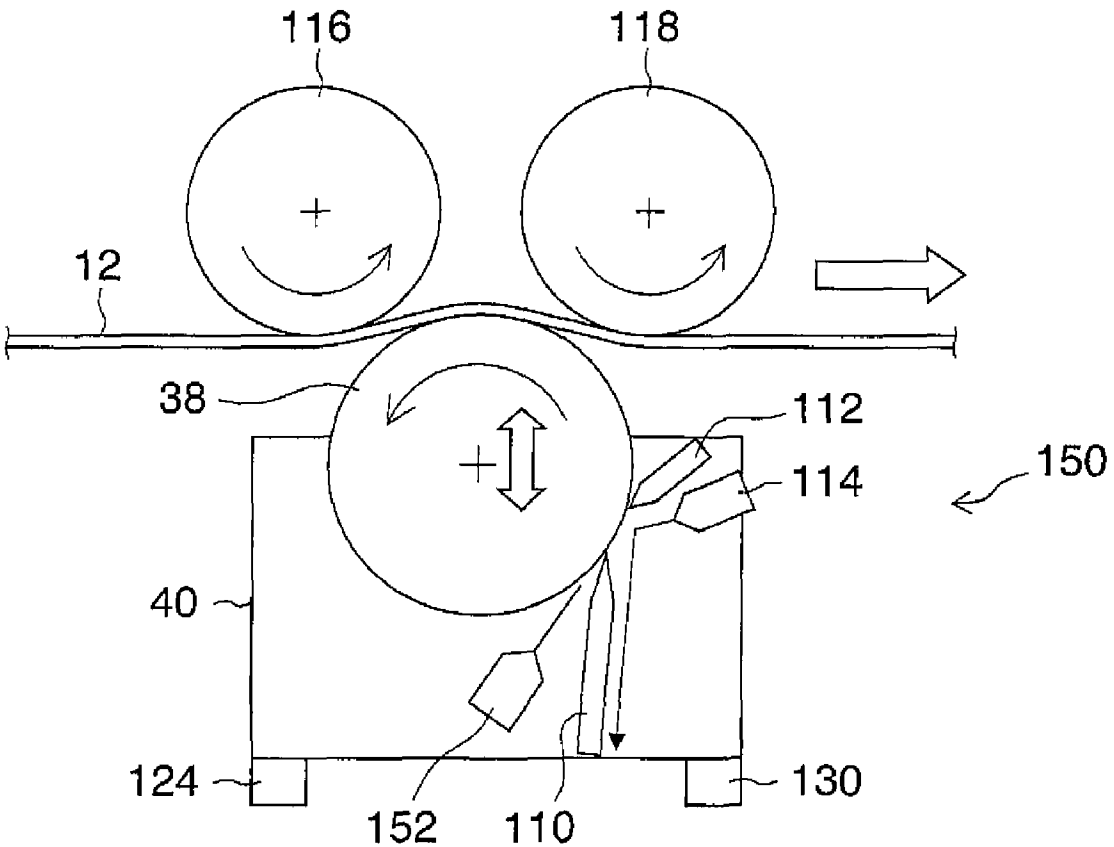
FIG. 12 is a compositional diagram showing a second embodiment of a liquid application apparatus used in a treatment liquid application unit.

FIG. 12 is a diagram showing a liquid application apparatus according to the second compositional example of the present invention. As shown in FIG. 12, the liquid application apparatus of the second compositional example is an apparatus in which the application range can be adjusted both in the breadthways direction and the conveyance direction of the intermediate transfer body 12. In FIG. 12, members which are the same as or similar to the composition described in FIG. 7 are labeled with the same reference numerals and description thereof is omitted here.

The liquid application apparatus 150 according to the second compositional example shown in FIG. 12 includes a treatment liquid spraying unit 152 as a device for applying a treatment liquid to the gravure roller 38. A single-fluid flat spray nozzle in which the spray angle can be adjusted, or a pressurized two-fluid flat spray nozzle, is used as the spraying member of the treatment liquid spraying unit 152. More specifically, the nozzle used is, for example, a single-fluid flat spray nozzle having an orifice diameter of approximately 0.2 mm through 0.4 mm and a spray angle of 60° through 100°, or a pressurized two-fluid flat spray nozzle of similar size.

As shown in FIG. 12, the treatment liquid spraying unit 152 sprays the treatment liquid toward the vicinity of the front end of the squeegee blade 110 from below the gravure roller 38. In this case, the spraying pressure is controlled in such a manner that the spraying angle is set so as to achieve an application width which matches the width of the image forming region.

Figure 13:
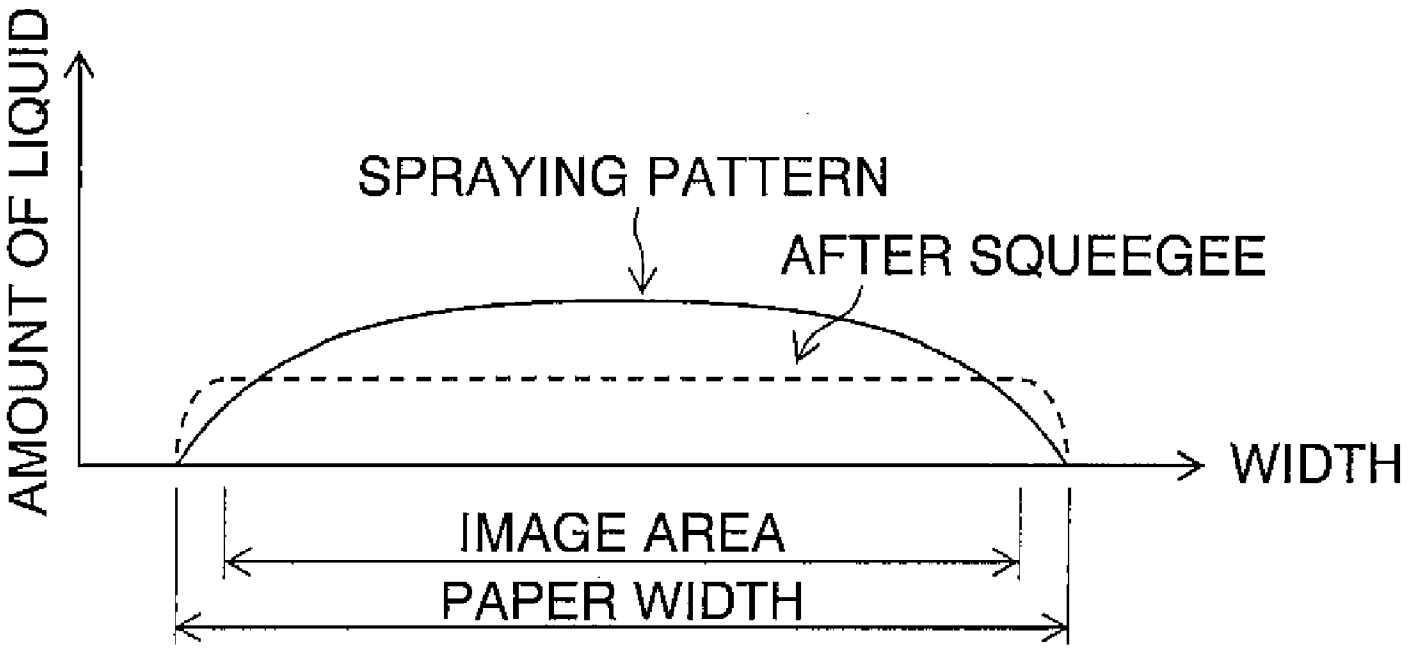
FIG. 13 is a graph showing the liquid volume distribution of a liquid spraying pattern achieved by a flat spray.

As shown in FIG. 13, the liquid spray pattern achieved by the flat spray creates a liquid amount distribution in the breadthways direction. Furthermore, the spray amount (flow rate) varies depending on the spraying pressure. However, in the case of the present embodiment, since excess treatment liquid is removed by the squeegee blade 110, in such a manner that the liquid can be applied in a paper width range which is broader than the width of the effective image area, then it is possible to keep the amount of the treatment liquid applied onto the gravure roller 38 to a stable amount, and it is possible to achieve uniform application with a controlled application width.

As shown in FIG. 12, similarly to the first compositional example, the liquid application apparatus 150 includes the substitute fluid spraying unit 114. As described in the first compositional example, the substitute fluid spraying unit 114 selectively removes the treatment liquid in respect of the circumferential direction of the gravure roller 38.

Furthermore, similarly to the first compositional example, the squeegee blade 110 in FIG. 12 also serves as a partition for the treatment liquid container 40, and functions as a member for separating the treatment liquid which has been wiped away from the gravure roller 38 and the removed liquid which has been removed by means of the substitute fluid.

According to the liquid application apparatus of the second compositional example having the composition described above, the treatment liquid application width in the breadthways direction is controlled by means of the treatment liquid spraying unit 152, and the treatment liquid application range in the conveyance direction of the intermediate transfer body (the circumferential direction of the gravure roller 38) is controlled by the substitute fluid spraying unit 114.

Figure 14:
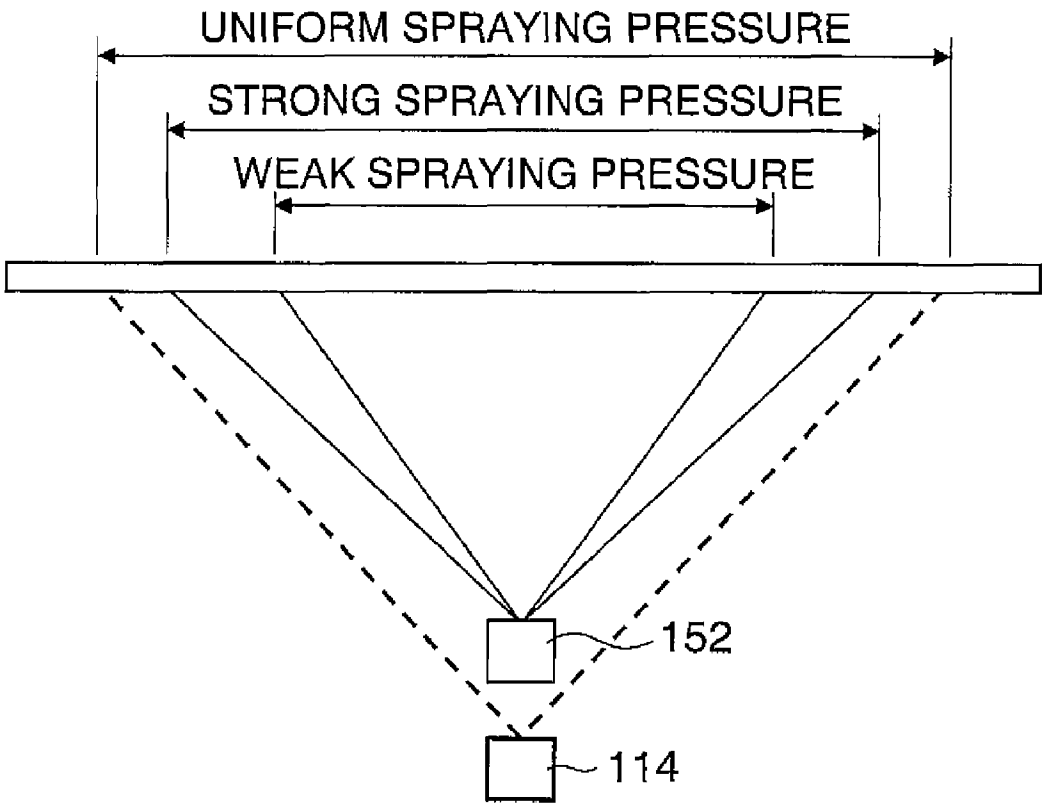
FIG. 14 is a schematic drawing showing the relationship between a treatment liquid spraying unit and a substitute fluid spraying unit.

FIG. 14 is an illustrative diagram showing a schematic drawing of the relationship between the treatment liquid spraying unit 152 and the substitute fluid spraying unit 114. As shown in FIG. 14, the nozzle of the treatment liquid spraying unit 152 can be switched between at least two different spray widths (spraying ranges in the breadthways direction). FIG. 14 shows an example in which two spray widths are achieved on the basis of the strength of the spraying pressure, but it is also possible to adopt a mode in which three or more spray widths are achieved, in accordance with the different sizes of the recording medium 14. Information relating to the recording medium 14 may be acquired automatically by means of a sensor, or the like, or it may be inputted by the operator.

The nozzle of the substitute fluid spraying unit 114 has a spraying width which is larger than the maximum spraying width of the treatment liquid spraying unit 152 (in the case shown in FIG. 14, the spraying width when the spray pressure is high). Since the spraying width of the substitute fluid spraying unit 114 does not need to be controlled, then the spraying pressure is uniform, and the substitute fluid may be controlled simply between a spray on and a spray off state. In the present embodiment, the spraying width of the substitute fluid spraying unit 114 is fixed, from the viewpoint of simplifying the composition of the apparatus, but it is also possible to adopt a composition which switches the spraying width of the substitute fluid spraying unit 114, in accordance with the switching of the spraying width of the treatment liquid spraying unit 152.

Figure 15:
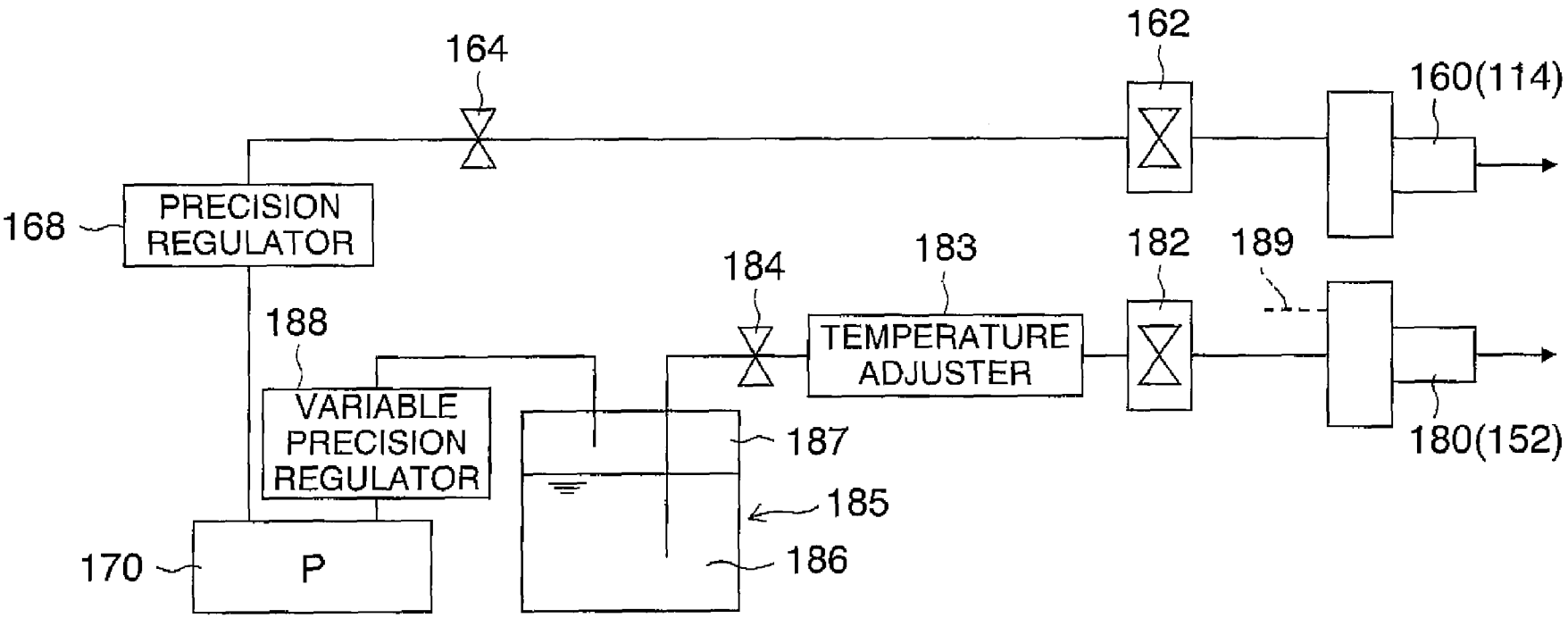
FIG. 15 is a diagram showing a compositional example of a liquid supply system in a case where a gas (air) is used as the substitute fluid.

FIG. 15 is a diagram showing a compositional example of a liquid supply system in a case where a gas (air) is used as the substitute fluid. The nozzle body 160 of the substitute fluid spraying unit 114 is connected to a compressor 170, via an electromagnetic valve 162, a manual valve 164, and a precision regulator 168. The compressed air from the compressor 170 is kept to a prescribed pressure by the precision regulator 168, and the air spray from the nozzle body 160 is switched on and off by switching the electromagnetic valve 162 on and off. By this means, the air spray pressure from the nozzle body 160 is uniform, and a prescribed spraying width is achieved.

The nozzle body 180 of the treatment liquid spraying unit 152 is connected to the liquid layer 186 in a pressure container 185 via an electromagnetic valve 182, a temperature adjuster 183, and a manual valve 184. The liquid for spraying (in the present embodiment, the treatment liquid) is stored inside a sealed pressure container 185, and the gas layer 187 in the pressure container 185 is connected to the compressor 170 via a precision regulator 188 which enables the pressure to be changed and controlled.

The pressure of the liquid supplied from the pressure container 185 is adjusted by changing the pressure inside the pressure container 185 by means of the variable precision regulator 188. The liquid conveyed out from the pressure container 185 is heated to a prescribed temperature by the temperature adjuster 183, and is supplied to the nozzle body 180 via the electromagnetic valve 182. The spray of liquid from the nozzle body 180 is switched on and off by switching the electromagnetic valve 182 on and off, and the spraying pressure, in other words, the spraying width from the nozzle body 180, is changed by controlling the pressure of the variable precision regulator 188. If a two-fluid air atomizing nozzle is used as the nozzle body 180 of the treatment liquid spraying unit 152, then compressed air is supplied to the air supply unit 189 of the nozzle body 180 via the regulator (not shown).

Although the supply system nm a case where a liquid is used as the substitute fluid is not described in detail, a liquid supply system similar to that of the treatment liquid is used instead of the air supply system to the nozzle body 160 shown in FIG. 15 (although pressure control is not required).

Figure 16:
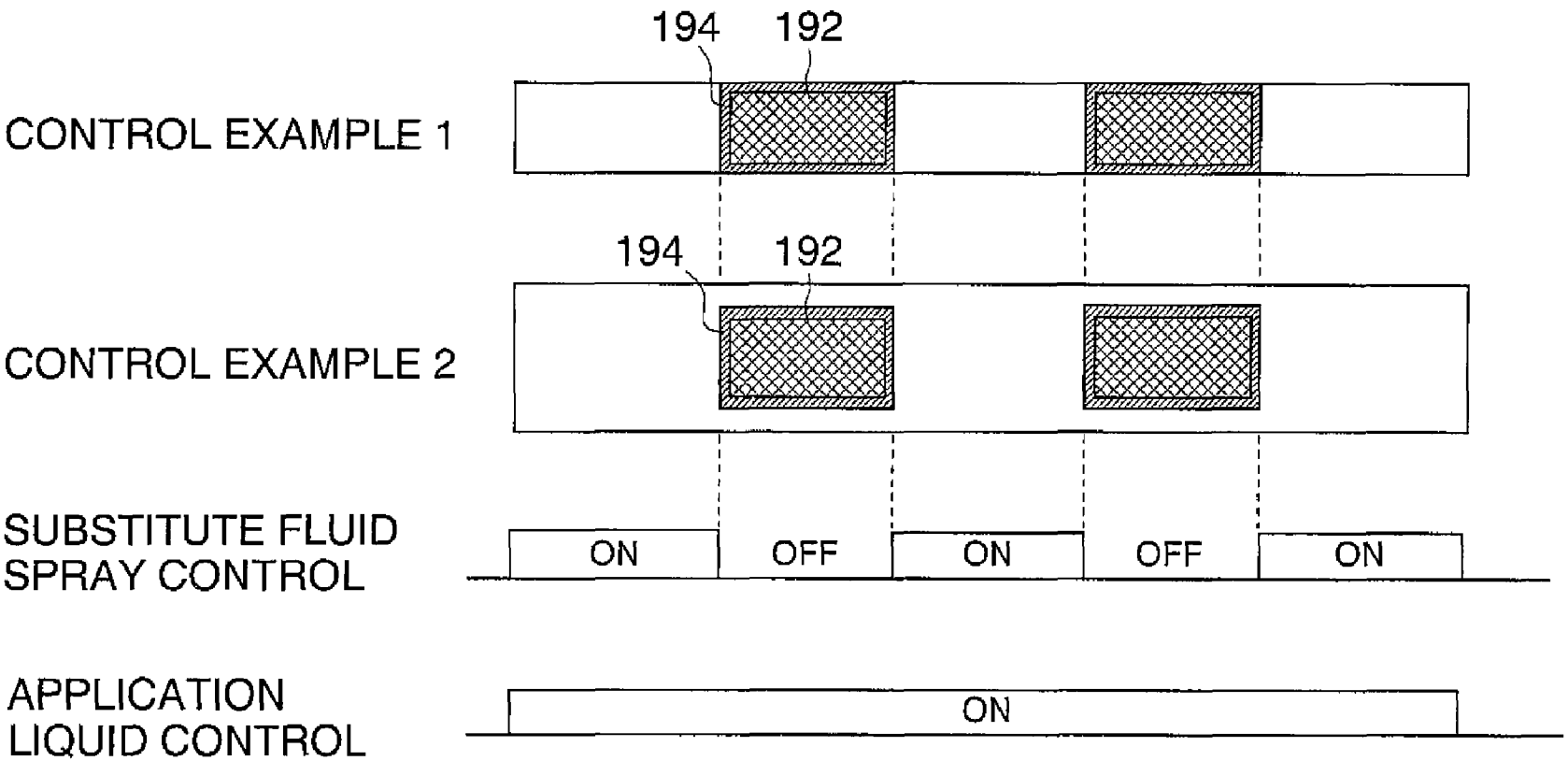
FIG. 16 is an illustrative diagram showing examples of control of the application range of the treatment liquid onto the intermediate transfer body.

FIG. 16 is a diagram showing examples of the control of the application of treatment liquid onto the intermediate transfer body 12 by means of the composition according to the first compositional example and the second compositional example described above. In FIG. 16, two types of application control are exemplified, one of which is a control example 1 which controls the application range (application surface area) in the conveyance direction of the intermediate transfer body 12 by adopting the first compositional example, and the other of which is a control example 2 which controls the application range in both the breadthways direction and conveyance direction of the intermediate transfer body 12 by adopting the second compositional example.

The intermediate transfer body 12 has a width which is greater than the region of the effective image unit 192 in which the primary image which is the object for transfer is formed, and the treatment liquid is applied to a region which is broader that the effective image unit 192 (the region of the application unit which corresponds to the recording medium size indicated by reference numeral 194).

FIG. 16 also shows the control timing for the substitute fluid spray according to the first compositional example and the second compositional example (which corresponds to the on/off control timing of the electromagnetic valve 162 shown in FIG. 15). Moreover, FIG. 16 also shows the control of the application of application liquid (treatment liquid) to the gravure roller according to the first compositional example and the second compositional example.

As shown in FIG. 16, the application liquid (treatment liquid) is temporarily applied uniformly and continuously on the actual gravure roller 38, and the application range of the treatment liquid is ultimately controlled in the conveyance direction by controlling the spraying of the substitute fluid (i.e., the treatment liquid that has been temporarily applied on the intermediate transfer body is selectively removed by means of the substitute fluid).

Furthermore, in the composition of the liquid application apparatus 150 according to the second compositional example, the spraying pressure of the treatment liquid spraying unit 152 is controlled in accordance with the change in the size of the recording medium 14, and hence the application range in the breadthways direction is changed accordingly.

According to the liquid application apparatuses 100 and 150 of the first and second compositional examples, the following action and beneficial effects are obtained.

(1) Since a composition is adopted in which a substitute fluid is sprayed onto a partial region (the region corresponding to the non-image forming section) of the gravure roller 38 onto which the application liquid (the treatment liquid in the present embodiment) has been temporarily applied, thereby removing (substituting) the application liquid which has been applied on the region, then it is possible selectively to remove the application liquid (treatment liquid) which has been applied to the non-image forming section.

Furthermore, since the spraying of the substitute fluid is carried out with a spraying width which is greater than the application width of the treatment liquid, in respect of the portions of the intermediate transfer body 12 corresponding to the non-image forming region, then the treatment liquid can be removed infallibly.

(2) Since the shape and arrangement of the squeegee blade 110 and the arrangement of the substitute fluid spraying unit are devised in such a manner that the excess application liquid removed by spraying a substitute fluid, and the sprayed fluid, flow down along the squeegee blade 110, then stagnation of the application liquid at the front end portion of the squeegee blade 110 which abuts against the gravure roller 38 is not liable to occur, thus preventing adhesion and making it possible to achieve good control of the liquid removal in the direction of rotation.

(3) Since a partition of the treatment liquid container 40 is formed by means of the squeegee blade 110 itself, and an independent outlet port (the liquid recovery ports indicated by the reference numerals 124 and 130) are provided respectively for each space demarcated by the partition, then it is possible to separate the application liquid which has been wiped away by the squeegee blade 110 and the liquid which has been removed by the substitute fluid (if the substitute fluid is a liquid, then a mixed liquid of the removed application liquid and the substitute fluid), and the respective liquids can be collected independently.

(4) By setting the conditions in such a manner that the liquid which is sprayed as a substitute fluid has a surface tension of 60 mN/m through 80 mN/m (water which does not contain a surfactant, such as distilled water), and the surface energy of the intermediate transfer body is 15 mN/m through 30 mN/m (=mJ/m$^2$), then the surface tension of the substitute fluid is greater than the surface energy of the intermediate transfer body, and consequently it is possible to reduce the amount of substitute fluid applied to the intermediate transfer body, and effective dilution and removal of the application liquid component can be achieved. Moreover, in an intermediate transfer body having low surface energy, the amount of liquid applied is low and removal by means of heating is also possible.

(5) By adopting a composition in which the application of the application liquid onto the gravure roller 38 is carried out by liquid spraying from a flat spray (a flat-shaped line spray), as described in the second compositional example, then it is possible to control the application width by means of controlling the spraying pressure, as well as controlling the opening slit by means of the squeegee blade 110 and the shielding member 112.

In particular, in a mode which carries out a liquid spray by means of a flat spray nozzle, onto the intermediate transfer body 12 after a liquid cleaning step performed by the first cleaning unit 30, then since the residual thin film left after the liquid cleaning step forms a lubricating layer, it is possible to prevent abrasion with the intermediate transfer body 12 even in the portions of the gravure roller 38 where the application liquid is not applied.

(6) When not forming images, in other words, during standby or when the apparatus is halted, the application of application liquid to the gravure roller is halted (in the first compositional example, the liquid is removed from the treatment liquid container 40, and in the second compositional example, the spraying of liquid from the treatment liquid spraying unit 152 is halted), and furthermore, the substitute fluid (gas or liquid) keeps to be sprayed for a prescribed period of time, thereby cleaning the surface of the gravure roller and making it possible to minimize solidification of the application liquid or corrosion caused by the components of the application liquid (in the present embodiment, acid). In particular, if a liquid having few impurities, such as distilled water, is used as the substitute fluid, then the cleaning becomes even more effective.

Description of Control System

Figure 17:
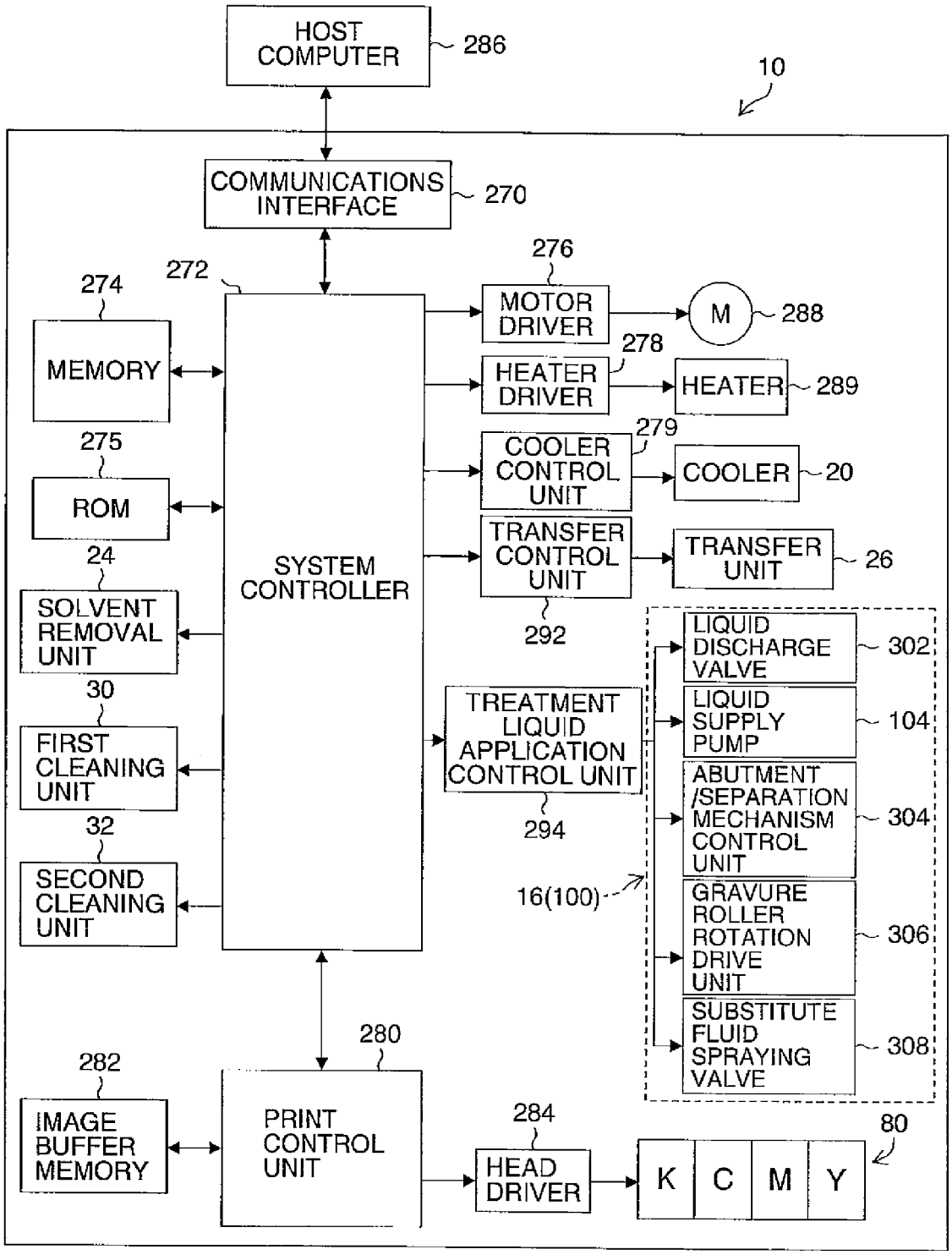
FIG. 17 is a block diagram showing the system configuration of the inkjet recording apparatus according to the first embodiment.

FIG. 17 is a principal block diagram showing the system configuration of the inkjet recording apparatus 10. The inkjet recording apparatus 10 includes a communication interface 270, a system controller 272, a memory 274, a motor driver 276, a heater driver 278, a cooler control unit 279, a print control unit 280, an image buffer memory 282, an ink head driver 284, and the like.

The communication interface 270 is an interface unit for receiving image data sent from a host computer 286. A serial interface such as USB (Universal Serial Bus), IEEE1394, Ethernet (registered trademark), wireless network, or a parallel interface such as a Centronics interface may be used as the communication interface 270. A buffer memory (not shown) may be mounted in this portion in order to increase the communication speed. The image data sent from the host computer 286 is received by the inkjet recording apparatus 10 through the communication interface 270, and is temporarily stored in the memory 274.

The memory 274 is a storage device for temporarily storing images inputted through the communication interface 270, and data is written and read to and from the memory 274 through the system controller 272. The memory 274 is not limited to a memory composed of semiconductor elements, and a hard disk drive or another magnetic medium may be used.

The system controller 272 is constituted by a central processing unit (CPU) and peripheral circuits thereof and the like, and it functions as a control device for controlling the whole of the inkjet recording apparatus 10 in accordance with a prescribed program, as well as a calculation device for performing various calculations. More specifically, the system controller 272 controls the various sections, such as the communication interface 270, memory 274, motor driver 276, heater driver 278, a cooler control unit 279, and the like, as well as controlling communications with the host computer 286 and writing and reading to and from the memory 274, and it also generates control signals for controlling the motor 288 and heater 289 of the conveyance system.

The program executed by the CPU of the system controller 272 and the various types of data which are required for control procedures are stored in the ROM 275. The ROM 275 may be a non-writeable storage device, or it may be a rewriteable storage device, such as an EEPROM. The memory 274 is used as a temporary storage region for the image data, and it is also used as a program development region and a calculation work region for the CPU.

The motor driver 276 is a driver which drives the motor 288 in accordance with instructions from the system controller 272. In FIG. 17, the motors disposed in the respective sections in the apparatus are represented by the reference numeral 288. For example, the motor 288 shown in FIG. 17 includes a motor which drives the drive rollers in the tensioning rollers 34A to 34C in FIG. 1, a motor of the movement mechanism of the solvent removal roller 42, a motor of the movement mechanisms of the transfer roller 36 and the pressurization roller 48, and the like.

The heater driver 278 shown in FIG. 17 is a driver which drives the heater 289 in accordance with instructions from the system controller 272. In FIG. 17, the plurality of heaters which are provided in the inkjet recording apparatus 10 are represented by the reference numeral 289. For instance, the heater 289 shown in FIG. 17 includes a heater of a heating unit 18 shown in FIG. 1, a pre-heater 46, and the like.

The cooler control unit 279 in FIG. 17 is a control unit which controls the temperature of the cooler 20 (see FIG. 1) in accordance with the instructions from the system controller 272.

The print control unit 280 has a signal processing function for performing various tasks, compensations, and other types of processing for generating print control signals from the image data stored in the memory 274 in accordance with commands from the system controller 272 so as to supply the generated print data (dot data) to the head driver 284. Prescribed signal processing is carried out in the print control unit 280, and the ejection amount and the ejection timing of the ink droplets from the respective print heads 80 are controlled via the head driver 284, on the basis of the print data. By this means, prescribed dot size and dot positions can be achieved.

The print control unit 280 is provided with the image buffer memory 282; and image data, parameters, and other data are temporarily stored in the image buffer memory 282 when image data is processed in the print control unit 280. The aspect shown in FIG. 17 is one in which the image buffer memory 282 accompanies the print control unit 280; however, the memory 274 may also serve as the image buffer memory 282. Also possible is an aspect in which the print control unit 280 and the system controller 272 are integrated to form a single processor.

To give a general description of the sequence of processing from image input to print output, image data to be printed is input from an external source via a communications interface 270, and is accumulated in the memory 274. At this stage, RGB image data is stored in the memory 274, for example.

In this inkjet recording apparatus 10, an image which appears to have a continuous tonal graduation to the human eye is formed by changing the droplet ejection density and the dot size of fine dots created by ink (coloring material), and therefore, it is necessary to convert the input digital image into a dot pattern which reproduces the tonal gradations of the image (namely, the light and shade toning of the image) as faithfully as possible. Therefore, original image data (RGB data) stored in the memory 274 is sent to the print control unit 280 through the system controller 272, and is converted to the dot data for each ink color by a half-toning technique, using a threshold value matrix, error diffusion, or the like, in the print control unit 280.

In other words, the print control unit 280 performs processing for converting the input RGB image data into dot data for the four colors of K, C, M and Y. The dot data generated by the print control unit 280 in this way is stored in the image buffer memory 282. The primary image formed on the intermediate transfer body 12 is a mirror image of the secondary image which is to be formed finally on the recording medium 14, taking account of the fact that it is reversed when transferred onto the recording medium. In other words, the drive signals supplied to the heads 22Y, 22M, 22C and 22K are drive signals corresponding to a mirror image, and therefore the input image is required to be subjected to reversal processing by the print control unit 280.

The head driver 284 outputs drive signals for driving the actuators 88 corresponding to the respective nozzles 81 of the heads 80, on the basis of the print data supplied by the print control unit 280 (in other words, the dot data stored in the image buffer memory 282). A feedback control system for maintaining constant drive conditions for the heads may be included in the head driver 284.

By supplying the drive signals output by the head driver 284 to the print heads 80, inks are ejected from the corresponding nozzles 81. An image (primary image) is formed on the intermediate transfer body 12 by controlling ink ejection from the heads 80 while conveying the intermediate transfer body 12 at a prescribed speed.

Furthermore, the system controller 272 controls the transfer control unit 292 and the to treatment liquid application control unit 294, and furthermore, it also controls the operation of the solvent removal unit 24, the first cleaning unit 30 and the second cleaning unit 32 described above with reference to FIG. 1.

The transfer control unit 292 shown in FIG. 17 controls the temperature and the nip pressure of the transfer roller 36 and the pressure roller 48 in the transfer unit 26 (see FIG. 1). The optimal values for the nip pressure and transfer temperature (target control values) are previously determined for each type of recording medium 14 and each type of ink, and this data is stored in a prescribed memory (for example, a ROM 275) in the form of a data table. When the system controller 272 acquires information about the recording medium 14 being used and the ink being used, on the basis of an input made by an operator, or by automatically reading in information by means of a prescribed sensor, then the system controller 272 controls the temperature and the nip pressure of the transfer roller 36 and the pressurization roller 48 accordingly, by referring to the data table.

The treatment liquid application control unit 294 shown in FIG. 17 controls the operation of the treatment liquid application unit 16 in accordance with the instructions from the system controller 272. If a liquid application apparatus 100 as shown in FIG. 7 is used for the treatment liquid application unit 16, then as shown in FIG. 17, the liquid discharge valve 302, the liquid supply pump 104, the abutment/separation mechanism drive unit 304 of the gravure roller, the gravure roller rotation drive unit 306, the substitute fluid spraying valve 308, and the like, are controlled by the treatment liquid application control unit 294.

In this case, the liquid discharge valve 302 includes the treatment liquid discharge valve 126 and the removed liquid discharge valve 132 shown in FIG. 7. Furthermore, the substitute fluid spray valve 308 in FIG. 17 corresponds to an electromagnetic valve, or the like, which turns the spraying by substitute fluid spraying unit 114 shown in FIG. 7 on and off.

The system controller 272 judges the image forming region and the non-image forming region on the intermediate transfer body 12, on the basis of the image data that is to be printed, and it controls the on and off switching of the substitute fluid spraying valve 308 in such a manner that the treatment liquid is not applied onto the portion which corresponds to the non-image forming region (i.e., the system controller 272 controls the substitute fluid spraying valve 308 so that the treatment liquid does not remain on the portion corresponding to the non-image forming region). Consequently, the treatment liquid is applied selectively onto the portion of the intermediate transfer body 12 which corresponds to the image forming region. In the case of the present embodiment, the combination of the system controller 272 and the treatment liquid application control unit 294 functions as a "substitute fluid spray control device".

Figure 18:
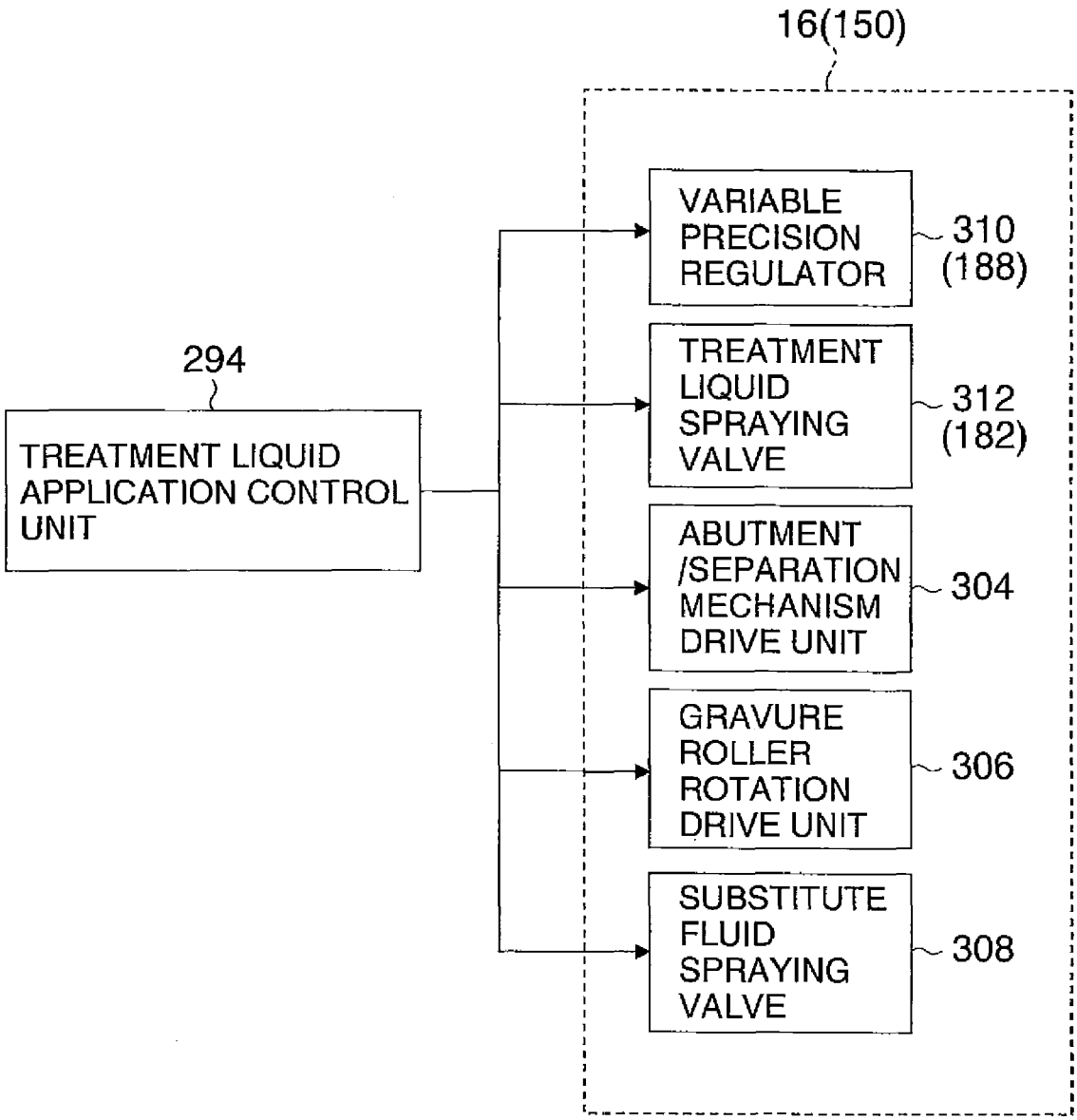
FIG. 18 is a principal block diagram showing the system composition when the liquid application apparatus shown in FIG. 12 is used.

In the treatment liquid application unit 16, if a liquid application apparatus 150 as shown in FIG. 12 is used, then instead of the composition involving the liquid discharge valve 302 and the liquid supply pump 104 shown in FIG. 17, the variable precision regulator 310 and the treatment liquid spray valve 312 are controlled, as shown in FIG. 18. The variable precision regulator 310 referred to here is a device which changes the spray pressure from treatment liquid spray unit 152 in FIG. 12, and it corresponds to the element indicated by reference numeral 188 in the example shown in FIG. 15.

Moreover, the treatment liquid spray valve 312 shown in FIG. 18 is a device for switching the spray of the treatment liquid spray unit 152 in FIG. 12, on and off, and it corresponds to the electromagnetic valve indicated by reference numeral 182 in the example in FIG. 15.

In the first embodiment which was described above, after applying an aggregation treatment agent (treatment liquid), the treatment agent is caused to dry so as to form a solid or semi-solid aggregation treatment agent layer, and droplets of ink are then deposited onto this layer. However, a mode is also possible in which the aggregation treatment agent is applied after droplets of ink are deposited on the intermediate transfer body. Below, this mode is described as a second embodiment.

Second Embodiment

Figure 19:
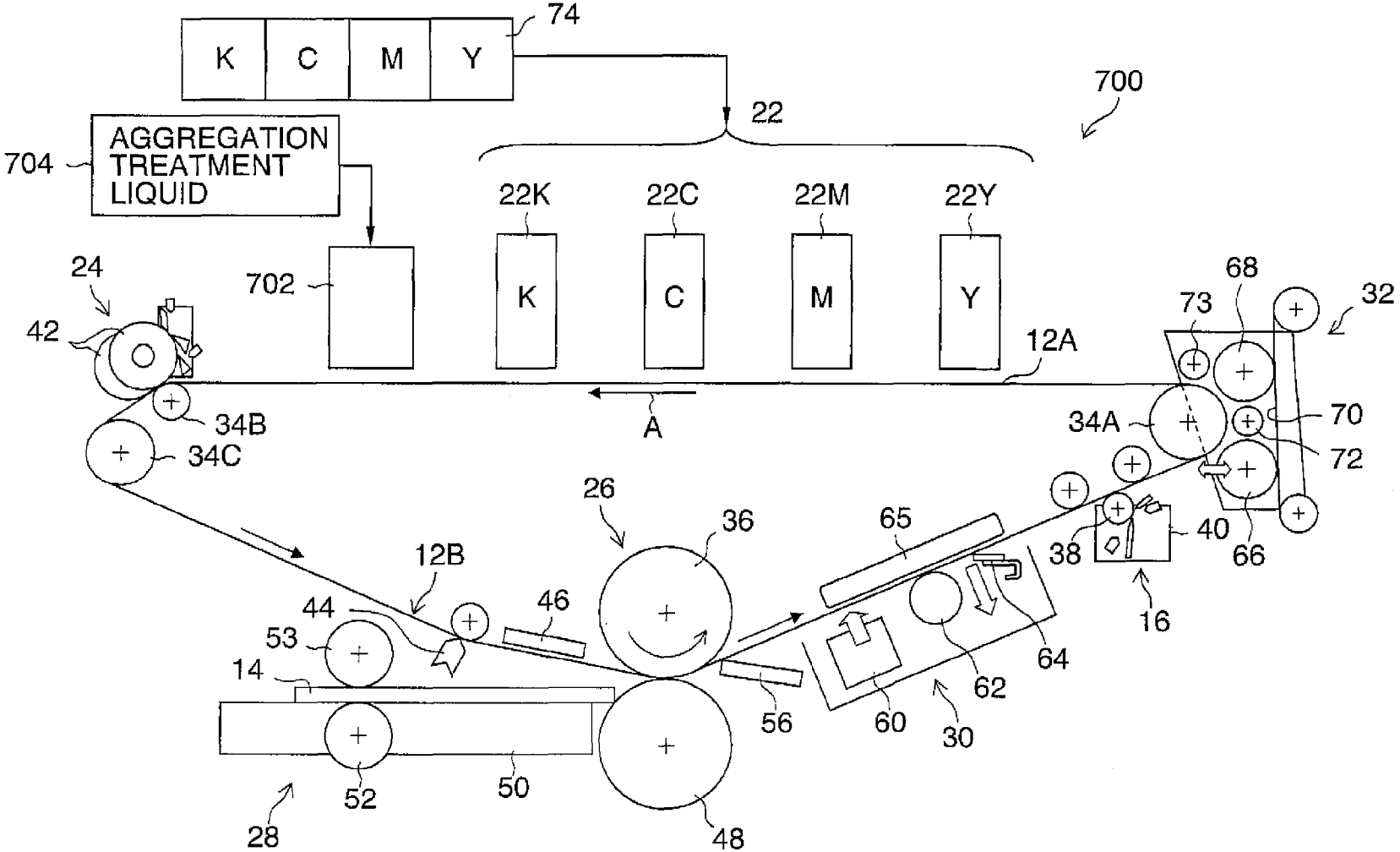
FIG. 19 is a general schematic drawing of an inkjet recording apparatus according to the second embodiment of the present invention.

FIG. 19 is a schematic drawing of an inkjet recording apparatus 700 according to a second embodiment. In FIG. 19, elements which are the same as or similar to the composition in FIG. 1 are labeled with the same reference numerals and description thereof is omitted here.

The inkjet recording apparatus 700 shown in FIG. 19 differs from the inkjet recording apparatus 10 shown in FIG. 1 according to the first embodiment, in respect of the undercoating liquid applied by the treatment liquid application unit 16. Moreover, the inkjet recording apparatus 700 differs from the inkjet recording apparatus 10 in that the inkjet recording apparatus 700 is provided with a liquid ejection head (hereinafter, called "aggregation liquid head") 702 which is arranged on the downstream side of the print unit 22 and deposits an aggregation treatment liquid, instead of the heating unit 18 and cooler 20 in FIG. 1.

In other words, the inkjet recording apparatus 700 shown in the present embodiment employs a three-liquid image forming method, in which a first treatment liquid layer is formed by means of an undercoating liquid (hereinafter, called the "first treatment liquid") on the intermediate transfer body 12, droplets of ink are ejected into this first treatment liquid layer, and then droplets of an aggregation treatment liquid (hereinafter, called the "second treatment liquid") which has the function of causing the ink droplets to aggregate are ejected in accordance with the liquid ink droplets in the first treatment liquid layer, thereby causing the coloring material (pigment) in the ink to aggregate and thus forming an ink aggregate.

The first treatment liquid which is applied by the treatment liquid application unit 16 of this inkjet recording apparatus 700 is a liquid which does not have the function of aggregating the ink droplets, even if it makes contact with the ink droplets; for example, a liquid obtained by removing the coloring material pigment) from the ink liquid used in the print unit 22 can be used as the first treatment liquid. An example of the preparation of the first treatment liquid is shown in Table 5.

TABLE 5

| Material | Weight % |
|---|---|
| Latex LX-2 | 8 |
| Glycerine (made by Wako Pure Chemical Industries Co., Ltd.) | 20 |
| Diethylene glycol (made by Wako Pure Chemical Industries Co., Ltd.) | 10 |
| Olfine E1010 (made by Nissin Chemical Industry Co., Ltd.) | 1 |
| Deionized water | 61 |

The aggregation treatment liquid (second treatment liquid) ejected from the aggregation liquid head 702 is desirably a treatment liquid which has the function of generating an ink aggregate by causing the pigment (coloring material) and the polymer micro-particles contained in the ink to aggregate by altering the pH of the ink.

The aggregation treatment liquid storing and loading unit 704 shown in FIG. 19 is constituted by a tank which stores the second treatment liquid which is supplied to the treatment liquid head 702. The tank is connected to the treatment liquid head 702 via a prescribed flow channel.

The aggregation liquid head 702 according to the present embodiment uses the same composition as the head disposed in the print unit 22. Provided that it is possible to deposit aggregation treatment liquid by a non-contact method onto the intermediate transfer body 12, the aggregation liquid head 702 may adopt a structure having a reduced droplet ejection density (resolution) compared to the ink heads 22Y, 22M, 22C and 22K, and it may also adopt a method other than an inkjet method, such as a spray method.

Desirably, the component of the second treatment liquid is selected from: polyacrylic acid, acetic acid, glycol acid, malonic acid, malic acid, maleinic acid, ascorbic acid, succinic acid, glutaric acid, fumaric acid, citric acid, tartaric acid, lactic acid, sulfonic acid, orthophosphoric acid, pyrrolidone carboxylic acid, pyrone carboxylic acid, pyrrole carboxylic acid, furan carboxylic acid, pyridine carboxylic acid, cumaric acid, thiophene carboxylic acid, nicotinic acid, or derivatives of these compounds, or salts of these, or the like.

A desirable example of the second treatment liquid is a treatment liquid to which a multivalent salt or polyallylamine has been added. These compounds may be used singly, or a combination of two or more of these compounds may be used.

From the viewpoint of the pH aggregating performance with respect to the ink, the second treatment liquid desirably has a pH of 1 through 6, more desirably, a pH of 2 through 5, and particularly desirably, a pH of 3 through 5.

The added amount, in the second treatment liquid, of the compound which causes aggregation of the ink pigment and polymer micro-particles, is desirably not less than 0.01 wt % and not more than 20 wt %, with respect to the total weight of the liquid. If the amount is less than 0.01 wt %, then when the ink comes into contact with the second treatment liquid, the concentration and dispersion do not advance sufficiently, and a sufficient aggregating action on the basis of the pH change may not be produced. If, on the other hand, the amount is more than 20 wt %, then there are concerns over deterioration of the ejection performance from the inkjet head (for example, the occurrence of ejection abnormalities).

Desirably, the second treatment liquid contains water and another organic solvent which is capable of dissolving the additive, in order to prevent blocking of the nozzles of the ejection head (702) due to drying. The water or other organic solvent capable of dissolving the additive includes a moistening agent or a penetrating agent. These solvents can be used independently, or in plural fashion, together with the other additive.

The content of the water and the other organic solvent capable of dissolving the additive should desirably be not more than 60 wt % with respect to the total weight of the second treatment liquid. If the content is more than 60 wt %, then the viscosity of the treatment liquid increases, and the ejection characteristics from the inkjet head may deteriorate.

It is also possible to include a resin component in the second treatment liquid in order to improve the fixing characteristics and the rub resistance. The resin component may be any resin which would not impair the ejection characteristics from the head and which has stable storage characteristics in cases where the treatment liquid is ejected in the form of droplets by an inkjet method, and it is possible freely to choose a water-soluble resin, resin emulsion, or the like.

The resin component may be an acrylic polymer, a urethane polymer, a polyester polymer, a vinyl polymer, a styrene polymer, or the like. In order to display sufficiently the functions of the material in improving fixing characteristics, it is necessary to add a polymer of relatively high molecular weight, at a high concentration (1 wt % through 20 wt %). However, if it is sought to add the aforementioned materials by dissolving in the liquid, then the viscosity of the liquid increases and the ejection characteristics decline. In order to add a suitable material at a high concentration or to suppress increase in the viscosity, it is effective to add the material in the form of a latex. Possible latex materials are, for instance: an alkyl copolymer of acrylic acid, carboxyl-modified SBR (styrene-butadiene latex), SIR (styrene-isoprene latex), MBR (methyl methacrylate-butadiene latex), NBR (acrylonitrile-butadiene latex), or the like.

The glass transition point Tg of the latex has a significant effect during the fixing process, and desirably, it is not lower than 50° C. or not higher than 120° C., in order to achieve both the stability during storage at normal temperature and good transfer characteristics after heating. Moreover, during the process, the minimum film forming temperature MFT also has a significant effect on fixing and in order to achieve suitable fixing at low temperatures, desirably it is 100° C. or lower, and more desirably, 50° C. or lower.

A desirable mode is one where the second treatment liquid contains polymer micro-particles of opposite polarity to the ink, since this further enhances the aggregating properties by causing aggregation of the pigment and polymer micro-particles in the ink. Furthermore, the aggregating properties may be enhanced by including, in the second treatment liquid, a curing agent which corresponds to the polymer micro-particle component contained in the ink, in such a manner that the resin emulsion in the ink composition aggregates and produces a cross-linking or polymerization reaction, after the ink and second treatment liquid have come into contact.

The second treatment liquid may include a surfactant. Desirable examples of a surfactant are: in a hydrocarbon system, an anionic surface active agent, such as a salt of a fatty acid, an alkyl sulfate ester salt, an alkyl benzene sulfonate salt, an alkyl naphthalene sulfonate salt, a dialkyl sulfosuccinate salt, an alkyl phosphate ester salt, a naphthalene sulfonate/formalin condensate, a polyoxyethylene alkyl sulfonate ester salt, or the like; or a non-ionic surface active agent, such as a polyoxyethylene alkyl ether, a polyoxyethylene alkyl aryl ether, a polyoxyethylene fatty acid ester, a sorbitan fatty acid ester, a polyoxyethylene sorbitan fatty acid ester, a polyoxyethylene alkyl amine, a glycerine fatty acid ester, an oxyethylene oxypropylene block copolymer, and the like.

Furthermore, it is also desirable to use SURFYNOLS (Air Products & Chemicals Co. Ltd.), which is a acetylene-based polyoxyethylene oxide surface active agent. Furthermore, an amine oxide type of ampholytic surface active agent, such as N,N-dimethyl-N-alkyl amine oxide, is also desirable. Moreover, the surfactants cited on pages 37 to 38 of Japanese Patent Application Publication No. 59-157636, and the surfactants cited in Research Disclosure No. 308119 (1989), can be used as the surfactant of the second treatment liquid.

Furthermore, it is also possible to use a fluorine (alkyl fluoride) type, or silicone type of surface active agent such as those described in Japanese Patent Application Publication No. 2003-322926, Japanese Patent Application Publication No. 2004-325707, and Japanese Patent Application Publication No. 2004-309806. It is also possible to use a surface tension adjuster of this kind as an anti-foaming agent; and a fluoride or silicone compound, or a chelating agent, such as EDTA, can also be used.

If the surfactant described above is included in the second treatment liquid, then a beneficial effect is obtained in that the surface tension of the second treatment liquid is lowered and the wetting properties on the intermediate transfer body are improved. Desirably, the surface tension of the second treatment liquid is 10 through 50 mN/m, and in the case of application by means of an inkjet method, more desirably, the surface tension of the second treatment liquid is 15 through 45 mN/m from the viewpoint of achieving finer liquid droplets and improving the ejection performance.

Desirably, the viscosity of the second treatment liquid is 1.0 through 20.0 cP, from the viewpoint of depositing by means of an inkjet method. It is also possible to add, to a second treatment liquid, a pH buffering agent, an anti-oxidation agent, an anti-rusting agent, a viscosity adjusting agent, a conducting agent, an ultraviolet light absorbing agent, and the like.

Figure 20:
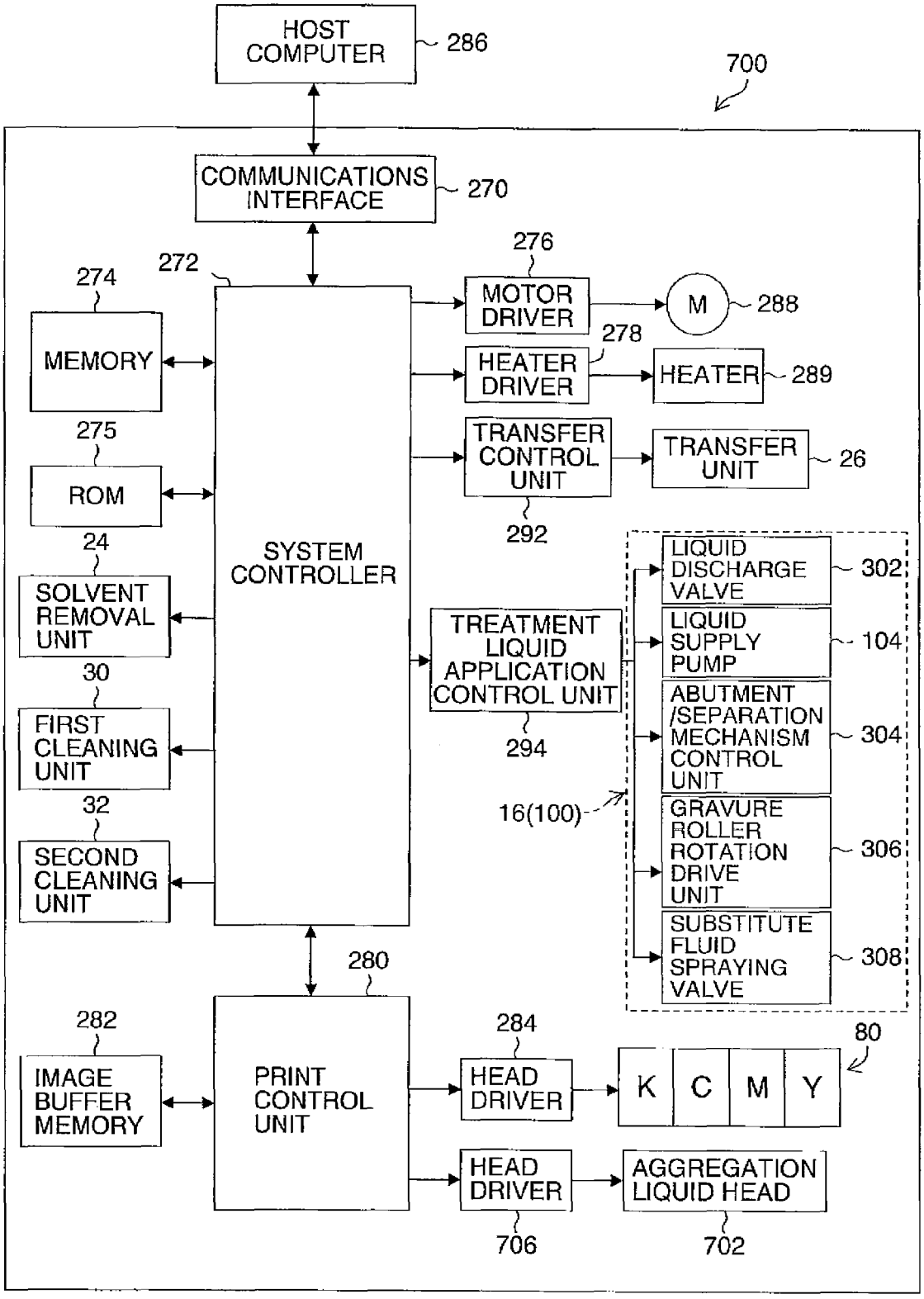
FIG. 20 is a block diagram showing the system configuration of the inkjet recording apparatus according to the second embodiment.

FIG. 20 is a block diagram of the inkjet recording apparatus 700 shown in FIG. 19. In FIG. 20, elements which are the same as or similar to the example in FIG. 17 are labeled with the same reference numerals and description thereof is omitted here.

In the inkjet recording apparatus 700 shown in FIG. 20, an aggregation liquid head 702 and a head driver 706 which drives this head are provided as devices for depositing the aggregation treatment liquid (second treatment liquid). The head driver 706 generates drive signals to be applied to the actuators 88 in the aggregation liquid head 702, on the basis of image data supplied from the print control unit 280, and also comprises drive circuits which drive the actuators 88 by applying the drive signals to the actuators 88. In this way, a desirable mode is one in which a composition for ejecting droplets of aggregation liquid in accordance with the image data is adopted, and droplets of aggregation treatment liquid are ejected selectively onto the positions where droplets of ink have been deposited by the print unit 22, but it is also possible to adopt a mode in which the aggregation liquid is deposited in a uniform fashion by using a spray nozzle.

Instead of the treatment liquid application unit 16 shown in FIG. 20, it is also possible to adopt the composition shown in FIG. 18.

Furthermore, in the respective embodiments described above, an endless belt is used as the intermediate transfer body, but it is also possible to adopt a mode which uses a drum-shaped intermediate transfer body. In this case, from the viewpoint of the processing characteristics and the thermal control characteristics, it is desirable to use an intermediate transfer body formed by coating a fluorine elastomer onto the surface of a thin aluminum tube which is reinforced by ribs.

The scope of application of the liquid application apparatus according to the present invention is not limited to an inkjet recording apparatus as described above, and it may also be applied to various other types of apparatuses, such as an industrial precision application apparatus, a resist printing apparatus, a wiring printing apparatus for forming electronic circuit boards, a dye processing apparatus, a coating apparatus, or the like.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid application apparatus, comprising:

a roller member which is driven so as to rotate in a rotational direction;

an application liquid supply device which supplies an application liquid onto a portion of the roller member while the roller member is rotating;

a blade member which is arranged so as to abut against a circumferential surface of the roller member at an abutment position that is on a downstream side of the application liquid supply device in terms of the rotational direction of the roller member, the blade member wiping away an excess of the supplied application liquid on the roller member;

a substitute fluid spray device which is arranged on a downstream side of the abutment position of the blade member in terms of the rotational direction of the roller member, the substitute fluid spray device spraying a substitute fluid onto a region of the circumferential surface of the roller member at a spraying position so as to remove the application liquid on the region of the circumferential surface of the roller member after passing the abutment position of the blade member, the substitute fluid including one of gas and liquid that is different from the application liquid; and a substitute fluid spray control device which controls the substitute fluid spray device whether or not to spray the substitute fluid so as to remove the application liquid on the circumferential surface of the roller member selectively in respect of a circumferential direction of the roller member, wherein the application liquid remaining on the circumferential surface of the roller member after passing the spraying position of the substitute fluid spray device is applied onto an application receiving body.

2. The liquid application apparatus as defined in claim 1, wherein the circumferential surface of the roller member has recess sections to retain the application liquid.

3. The liquid application apparatus as defined in claim 1, wherein:

the substitute fluid spray device sprays the substitute fluid onto the circumferential surface of the roller member within a sprayable range that is wider in a width direction of the roller member than a range on which the application liquid is supplied.

4. The liquid application apparatus as defined in claim 1, further comprising a shielding member which is arranged on a downstream side of the substitute fluid spray device in terms of the rotational direction of the roller member, the shielding member preventing the application liquid from scattering when the substitute fluid spray device removes the application liquid, wherein the substitute fluid spray device sprays the substitute fluid onto the region of the circumferential surface of the roller member that is exposed between the blade member and the shielding member.

5. The liquid application apparatus as defined in claim 4, wherein the shielding member is disposed nearby the blade member so as to restrict the region of the circumferential surface of the roller member exposed between the blade member and the shielding member in terms of the rotational direction of the roller member.

6. The liquid application apparatus as defined in claim 1, wherein the blade member has an inclined surface along which the removed application liquid flows down from the circumferential surface of the roller member, substantially in a direction of gravity.

7. The liquid application apparatus as defined in claim 1, further comprising a container which accommodates the roller member and the blade member, wherein the blade member also serves as a partition which divides an interior of the container, and separates the excess of the application liquid wiped away by the blade member and the application liquid removed by the substitute fluid spray device.

8. The liquid application apparatus as defined in claim 1, wherein the application liquid supply device includes a container that stores the application liquid, the rotating roller member being immersed in the application liquid stored in the container so as to be supplied with the application liquid.

9. The liquid application apparatus as defined in claim 1, wherein the application liquid supply device includes an application liquid spray device which sprays the application liquid onto the portion of the roller member.

10. The liquid application apparatus as defined in claim 9, further comprising a spray width control device which variably controls a spray width of the application liquid sprayed from the application liquid spray device.

11. The liquid application apparatus as defined in claim 1, wherein the application liquid remaining on the circumferential surface of the roller member is applied onto the application receiving body by conveying the application receiving body in a direction opposite to the rotational direction of the roller member while the application receiving body is in contact the circumferential surface of with the roller member.

12. The liquid application apparatus as defined in claim 11, wherein:

the application receiving body is an intermediate transfer body in an inkjet recording apparatus of intermediate transfer type which includes a cleaning device to clean the intermediate transfer body; and the application liquid is a treatment liquid and is applied on the intermediate transfer body after the intermediate transfer body is cleaned by the cleaning device and before ink droplets are deposited on the intermediate transfer body.

13. An image forming apparatus, comprising:

a treatment liquid application device which includes the liquid application apparatus as defined in claim 1 to apply a treatment liquid as the application liquid on an intermediate transfer body forming the application receiving body;

an ink ejection device which ejects and deposits droplets of ink in accordance with an image data onto the intermediate transfer body on which the treatment liquid has been applied by the treatment liquid application device, the deposited droplets of the ink forming an ink image selectively on an image forming region of the intermediate transfer body; and a transfer device which transfers the ink image from the intermediate transfer body to a recording medium, wherein the substitute fluid spray control device in the treatment liquid application device controls the substitute fluid spray device to spray the substitute fluid onto the region of the roller member corresponding to a non-image forming region of the intermediate transfer body other than the image forming region in accordance with the image data.

14. The image forming apparatus as defined in claim 13, wherein the substitute fluid has a surface energy of 60 mN/m through 80 mN/m, and the intermediate transfer body has a surface energy of 15 mN/m through 30 mN/m.

15. The image forming apparatus as defined in claim 14, wherein the surface energy of the intermediate transfer body is higher than a surface energy of the treatment liquid.

16. The image forming apparatus as defined in claim 13, wherein, when image formation is not performed on the recording medium, the treatment liquid is not applied on the roller member but the substitute fluid is sprayed onto the roller member.

17. The image forming apparatus as defined in claim 1, wherein the circumferential surface of the roller member has grooves.

18. A liquid application method comprising the steps of:

supplying an application liquid onto a portion of a roller member while rotating the roller member in a rotational direction;

wiping away an excess of the application liquid on the portion of the roller member by means of a blade member;

spraying a substitute fluid onto a region of the circumferential surface of the roller member after the wiping step so as to remove the application liquid on the region of the circumferential surface of the roller member, the substitute fluid including one of gas and liquid that is different from the application liquid;

controlling whether or not to spray the substitute fluid in the spraying step so as to remove the application liquid on the circumferential surface of the roller member selectively in respect of a circumferential direction of the roller member; and applying the application liquid remaining on the circumferential surface of the roller member after the spraying step onto an application receiving body.

* * * * *